US006755720B1

(12) United States Patent
Ishizaki et al.

(10) Patent No.: US 6,755,720 B1
(45) Date of Patent: Jun. 29, 2004

(54) VITRIFIED BOND TOOL AND METHOD OF MANUFACTURING THE SAME

(75) Inventors: Junji Ishizaki, Chiryu (JP); Kenji Ito, Kaizu-gun (JP); Tsuyoshi Fujii, Nagoya (JP); Kimihiro Watanabe, Seto (JP)

(73) Assignee: Noritake Co., Limited, Nagoya (JP)

( * ) Notice: Subject to any disclaimer, the term of this patent is extended or adjusted under 35 U.S.C. 154(b) by 0 days.

(21) Appl. No.: 09/613,427

(22) Filed: Jul. 10, 2000

(30) Foreign Application Priority Data

Jul. 15, 1999 (JP) ..... 11-201524
Feb. 29, 2000 (JP) ..... 2000-053453

(51) Int. Cl.[7] ..... B24B 1/00; B24B 9/00; C09K 13/14

(52) U.S. Cl. ..... 451/28; 51/298; 51/307; 451/72; 451/443

(58) Field of Search ..... 51/297, 307, 309, 51/298, 300; 451/56, 65, 72, 443, 527, 28, 533, 539, 547, 548

(56) References Cited

U.S. PATENT DOCUMENTS 3,963,458 A * 6/1976 Gladstone et al. ..... 51/295
RE30,691 E * 7/1981 Hallstrom et al. ..... 427/140
4,930,266 A * 6/1990 Calhoun et al. ..... 51/293
5,364,422 A * 11/1994 Kitajima et al. ..... 51/307
5,374,293 A * 12/1994 Takashita et al. ..... 51/295
5,380,390 A * 1/1995 Tselesin ..... 156/230
5,486,131 A * 1/1996 Cesna et al. ..... 451/56
5,569,062 A * 10/1996 Karlsrud ..... 451/285
5,891,204 A * 4/1999 Neff ..... 51/297
6,086,467 A * 7/2000 Imai et al. ..... 451/541
6,196,911 B1 * 3/2001 Preston et al. ..... 451/548
6,217,433 B1 * 4/2001 Herrman et al. ..... 451/548
6,312,324 B1 * 11/2001 Mitsui et al. ..... 451/540
6,354,929 B1 * 3/2002 Adefris et al. ..... 451/527

FOREIGN PATENT DOCUMENTS

| | | |
|---|---|---|
| JP | A 10-44023 | 2/1998 |
| JP | A 10-71559 | 3/1998 |
| JP | A 10-138120 | 5/1998 |
| JP | A 10-193266 | 7/1998 |

* cited by examiner

*Primary Examiner*—Timothy V. Eley
(74) *Attorney, Agent, or Firm*—Oliff & Berridge, PLC

(57) ABSTRACT

A vitrified bond tool including: (a) a support body; (b) a vitrified bond layer which is formed on a working surface of the support body; and (c) a plurality of abrasive grains which are held by the vitrified bond layer so as to be fixed relative to the working surface of the support body and which are spaced apart from each other with spacing between the adjacent ones of the abrasive grains. This vitrified bond tool is advantageously manufactured according to a method including the steps of (i) forming a pattern layer which includes a vitrified bond, in a predetermined pattern on the working surface of the support body; (ii) sprinkling the abrasive grains over the pattern layer before the pattern layer is dried; and (iii) firing the pattern layer and the abrasive grains which are bonded to the pattern layer and are arranged in the predetermined pattern on the working surface of the support body.

11 Claims, 14 Drawing Sheets

×25

×100

×50

×200

×250

×3000

VITRIFIED BOND TOOL AND METHOD OF MANUFACTURING THE SAME

BACKGROUND OF THE INVENTION

1. Field of the Invention

The present invention relates in general to a vitrified bond tool, and more particularly to such a vitrified bond tool including super abrasive grains and used as a dressing tool for dressing a polishing tool such as a polishing pad which is used for a chemical mechanical polishing of a semiconductor wafer.

2. Discussion of the Related Art

In a process of manufacturing a semiconductor, there is commonly practiced a chemical mechanical polishing (herein after referred to as "CMP") operation. In recent years, since a larger number of sheets of wafers are laminated with a larger scale of integration of electronic circuit, CMP operation is widely practiced for flattening surfaces of the wafers. In CMP operation, a polishing pad and a semiconductor wafer are rotated relative to each other, with application of a polishing fluid including fine abrasive grains to the polishing pad, for polishing the semiconductor wafer. In CMP operation for a semiconductor wafer, a high degree of flatness in the polished surface of the wafer is required by polishing a considerably small amount of the surface of the wafer. For satisfying this requirement, the polishing pad has to be dressed very frequently. The polishing pad has been conventionally dressed by using an electro-deposited diamond tool, which includes a base metal made of stainless or other metallic material, and diamond abrasive grains bonded to the base metal with Ni metal (electro-deposition bond).

JP-A-10-71559 discloses a dresser for dressing a polishing pad used for polishing a semiconductor wafer. This dresser includes a base metal and a diamond thin film. The to base metal has, in its working surface, a multiplicity of protrusions formed by using a wire-EDM (electro-discharge machining) or a metallic mold. The diamond thin film is formed on the working surface of the base metal by a vapor phase synthetic method.

JP-A-10-193266 discloses a method of a vitrified bond tool, which was proposed by the present inventors. This method is characterized by including the step of positioning a screen having a predetermined printing pattern, on a support body; the step of applying a paste including abrasive grains and vitrified bond which are dispersed in the paste, onto the support body through the screen; and the step of sintering the applied paste.

However, the operation for dressing the polishing pad with the electro-deposited diamond tool, in which the diamond abrasive grains are bonded to the base metal by Ni metal as an electro-deposition bond, suffers from elution of Ni metal into the polishing fluid whereby the workpiece is contaminated by Ni metal, particularly, where the polishing fluid is a strong-acid fluid. Further, the electro-deposited diamond tool has a drawback that all of the abrasive grains are not bonded to the base metal with sufficiently large bonding strength, due to the random arrangement of the abrasive grains in the abrasive layer, so that some of the abrasive grains which are not firmly bonded to the base metal are removed from the base metal and accordingly stay on the polishing pad. The workpiece is scratched or damaged by the abrasive grains thus staying on the polishing pad.

The dresser disclosed in JP-A-10-71559, in which abrasive grains are not used, requires a process of forming the multiplicity of protrusions in its base metal and also a process of forming the diamond thin film by the vapor phase synthetic method, thereby resulting in a considerably increased manufacturing cost. Dressers disclosed in JP-A-10-44023 and JP-A-10-138120 are costly to manufacture, too.

In the method disclosed in JP-A-10-193266, in which the paste including the abrasive grains and the vitrified bond therein is applied onto the support body through the screen, the abrasive grains are unlikely to be sufficiently dispersed in the paste, due to possible sedimentation of the abrasive grains, where each of the abrasive grains has a diameter larger than 40 $\mu$m. Thus, the paste applied onto the support body could be fixed to the support body in the sintering step, with agglomeration of the abrasive grains.

SUMMARY OF THE INVENTION

It is therefore a first object of the present invention to provide a vitrified bond tool having a construction which minimizes removal of the abrasive grains from the support body and accordingly prevents contamination or damage of a polishing tool and a workpiece to be polished by the polishing tool, and which is inexpensive to manufacture.

A second object of the invention is to provide a method suitable for manufacturing such a vitrified bond tool.

The first object indicated above may be achieved according to a first aspect of this invention, which provides a vitrified bond tool comprising: (a) a support body; (b) a vitrified bond layer which is formed on a working surface of the support body; and (c) a plurality of abrasive grains which are held by the vitrified bond layer so as to be fixed relative to the working surface of the support body and which are spaced apart from each other with spacing between adjacent ones of the abrasive grains.

In the vitrified bond tool according to the first aspect of the invention, the abrasive grains bonded to the vitrified bond tool are positioned relative to each other so as to be spaced apart from each other, so that each of the abrasive grains is bonded at an increased area of a surface thereof to the vitrified bond layer. Thus, all of the abrasive grains are bonded to the vitrified bond layer with sufficiently large bonding strength, thereby preventing removal of the abrasive grains from the vitrified bond layer or the support body, when this vitrified bond tool is used as a polishing or grinding tool for polishing or grinding a workpiece, or as a dressing tool for dressing a polishing or grinding tool. The workpiece polished or ground by this vitrified bond tool, or the polishing or grinding tool dressed by this vitrified bond tool and a workpiece polished or ground by the polishing or grinding tool is advantageously prevented from being contaminated and damaged by removal of the abrasive grains. The vitrified bond tool maintains its cutting sharpness throughout successive polishing or grinding operations, and accordingly exhibits an excellent polishing or grinding performance with high stability. In view of these advantages, the vitrified bond tool of this invention is suitable for dressing a polishing pad which is required to assure a high degree of flatness in a surface of a semiconductor wafer by polishing a considerably small amount of the surface of the wafer.

The vitrified bond tool provides other advantages. For example, the support body constituting a part of the vitrified bond tool may consist of a conventional support body. That is, a conventional support body can be used as the support body of the present vitrified bond tool, without necessity of a particular machining to the conventional support body.

In the present vitrified bond tool, agglomeration of the abrasive grains is prevented, so that each of the abrasive grains sufficiently exhibits its own polishing or grinding capacity. This makes it possible to reduce the amount or number of the abrasive grains to be used for each vitrified bond tool of the invention, thereby leading to a reduced manufacturing cost.

In the present vitrified bond tool in which each of the abrasive grains is bonded at an increased area of its surface to the vitrified bond layer, all of the abrasive grains are bonded to the vitrified bond layer with sufficiently large bonding strength, even with a reduced thickness of the vitrified bond layer. The reduced thickness of the vitrified bond layer facilitates protrusions of the abrasive grains from the vitrified bond layer after a firing step, i.e., after the manufacture of the tool, so that the vitrified bond tool does not have to be subjected to a truing operation, prior to an initial use thereof. That is, the vitrified bond tool exhibits an expected polishing or grinding performance even in the initial use without the truing operation.

The support body of the vitrified bond tool of the invention may be made of a ceramic or glassy material such as a silicon nitride or an alumina, without including any metallic material. Also in this view, the vitrified bond tool of the invention is suitable for dressing the polishing pad used to perform CMP operation for a semiconductor wafer which should be free from a metallic contamination.

It is desirable that thermal expansion coefficients of the abrasive grains, the vitrified bond layer and the support body are substantially equal to each other. That is, the difference between the abrasive grains and the vitrified bond layer in thermal expansion coefficients and the difference between the support body and the vitrified bond layer in thermal expansion coefficients are preferably not larger than $5\times10^{-6}$, more preferably not larger than $4\times10^{-6}$, and still more preferably not larger than $3\times10^{-6}$, for preventing cracking of the tool in the firing step.

According to a first preferred form of the first aspect of the invention, the abrasive grains protrude from a surface of the vitrified bond layer such that a distance over which each one of the abrasive grains protrudes from the surface of the vitrified bond layer corresponds to 20–70% of a diameter of the abrasive grain. This construction permits the abrasive grains to be held by the vitrified bond layer with a sufficiently high bonding strength, thereby preventing removal of the abrasive grains from the vitrified bond layer or the support body. If the protruding distance of each abrasive grain is larger than 70% of the diameter of the abrasive grain, the abrasive grain cannot be held by the vitrified bond layer with a sufficiently high bonding strength. If the protruding distance of each abrasive grain is smaller than 20% of the diameter of the abrasive grain, the dressing capacity of the vitrified bond tool is reduced.

According to a second preferred form of the first aspect of the invention, the abrasive grains are positioned relative to each other so as to be dotted on the working surface of the support body.

According to a third preferred form of the first aspect of the invention, the abrasive grains are positioned relative to each other such that the spacing between the adjacent ones of the abrasive grains is held in a predetermined range.

According to a fourth preferred form of the first aspect of the invention, the abrasive grains are positioned relative to each other by a precursor of the vitrified bond layer. It is noted that the precursor of the vitrified bond layer may be interpreted to correspond to a pattern layer which is described below.

The vitrified bond tools of the second, third and fourth preferred forms of the invention provide the same advantages as those of the vitrified bond tool of the first aspect of the invention as described above, and some additional advantages which will be clarified by description of preferred embodiments and examples as described below.

According to a fifth preferred form of the first aspect of the invention, the vitrified bond tool is designed as a dressing tool to be brought in sliding contact with a polishing surface of a polishing pad, for eliminating clogging in the polishing surface. The vitrified bond tool of this fifth preferred form further comprises, in addition to the plurality of abrasive grains as a plurality of first abrasive grains, a plurality of second abrasive grains whose average diameter is smaller than an average diameter of the first abrasive grains; wherein the working surface of the support body is a dressing surface which is forced onto the polishing surface of the polishing pad and which constitutes a part of a surface layer of the support body, at least the surface layer of the support body being made of an inorganic material; and wherein the second abrasive grains are held by the vitrified bond layer and are disposed on the dressing surface of the support body, such that the second abrasive grains are mingled together with each other, and such that the second abrasive grains are positioned between the first abrasive grains and are spaced apart from the first abrasive grains.

According to this fifth preferred form, in the dressing surface of the support body in which at least the surface layer is made of an inorganic material, the first abrasive grains which are spaced apart from each other are held by the vitrified bond layer, i.e., an inorganic bond layer, while the second abrasive grains whose average diameter is smaller than the average diameter of the first abrasive grains are also held by the vitrified bond layer such that the second abrasive grains are mingled together with each other. This construction prevents elution or effluence of a metallic component, even if a strong-acid fluid is used as the polishing fluid, thereby eliminating a risk of contamination of the workpiece. Further, the presence of the second abrasive grains between the adjacent ones of the first abrasive grains prevent the vitrified bond layer from being brought in contact with the polishing pad, thereby avoiding breakage of the vitrified bond layer.

The support body of the vitrified bond tool of this fifth preferred form may be made of a suitable ceramic material which has a high degree of chemical stability and sufficiently high degrees of strength and toughness for serving as a dressing tool. Such a ceramic material may be a sintered body of an inorganic material selected from alumina $Al_2O_3$, silicon nitride $Si_3N_4$, silicon carbide SiC, zirconia and mullite, or a glass having a high melting point. The vitrified bond layer of the vitrified bond tool of the fifth preferred form may be made of borosilicate glass, crystallized glass, silica glass, alumina, silicon nitride, silicon carbide, mullite, zirconia or other ceramic powders having sufficiently high degree of strength and toughness and a fusing point lower than that of the support body. Such suitable selections of materials for the support body and the vitrified bond layer are effective to avoid effluence of a metallic component into the polishing fluid thereby preventing the workpiece from being contaminated by an effluent metallic component, and also to avoid removal of the abrasive grains from the support body or the vitrified bond layer thereby preventing the workpiece from being scratched.

According to one advantageous arrangement of the fifth preferred form, the vitrified bond layer consists of a borosilicate glass including at least $SiO_2$ and $B_2O_3$ such that the content of $SiO_2$ therein is 40–70 wt % and the content of $B_2O_3$ therein is 10–30 wt %. The chemical composition of the borosilicate glass may include, for example, 40–70 wt % of $SiO_2$, 0–20 wt % of $Al_2O_3$, 10–30 wt % of $B_2O_3$, 0–10 wt % of at least one kind of metal oxide RO which is selected from alkaline earth metals, and 0–10 wt % of at least one kind of metallic oxide $R_2O$ which is selected from alkaline metals. This arrangement makes it possible to burn or fire the vitrified bond layer at a low temperature, thereby facilitating the manufacturing of the vitrified bond tool.

According to another advantageous arrangement of the fifth preferred form, the first abrasive grains have a higher degree of hardness than the second abrasive grains. The first and second abrasive grains may be made of diamond, CBN, alumina, silicon carbide, silicon nitride, mullite, silicon dioxide ($SiO_2$) or other material. For example, the first abrasive grains may be diamond abrasive grains having grain size of #100/#120, while the second abrasive grains may be alumina abrasive grains having grain size of #150/#180. According to this arrangement, the first abrasive grains which serve to dress the polishing pad have a comparatively high degree of hardness, while the second abrasive grains which serve to prevent contact of the vitrified bond layer with the polishing pad have a comparatively low degree of hardness and are made of a material comparatively cheap, thereby reducing the manufacturing cost of the vitrified bond tool.

According to still another advantageous arrangement of the fifth preferred form, the ratio of the number of the second abrasive grains to the number of the first abrasive grains is 1–10, or more preferably 2–5. This arrangement is effective to increase a load applied to each one of the first abrasive grains, thereby providing an excellent dressing performance. If the above-described ratio is lower than 1 or 2, namely, if the number of the first abrasive grains relative to the number of the second abrasive grains is too increased, the load applied to each first abrasive grain is made too small, resulting in a reduced dressing performance. On the other hand, if the above-described ratio is higher than 5 or 10, namely, if the number of the first abrasive grains relative to the number of the second abrasive grains is too reduced, the load applied to each first abrasive grain is made too large, undesirably increasing possibility of removal of the abrasive grains.

The above-indicated second object may be achieved according to a second aspect of this invention, which provides a method of manufacturing the vitrified bond tool as defined in the above-described first aspect of this invention. The present method comprises the steps of: (i) forming a pattern layer which includes a vitrified bond, in a predetermined pattern on the working surface of the support body; (ii) sprinkling the abrasive grains over the pattern layer before the pattern layer is dried; and (iii) firing the pattern layer and the abrasive grains which adhere to the pattern layer and are arranged in the predetermined pattern on the working surface of the support body.

The vitrified bond tool of the present invention can be manufactured according to this method of the second aspect of the invention with high efficiency and at a reduced cost. The present method provides the vitrified bond tool in which the abrasive grains are arranged in a direction parallel to the working surface of the support body so that the abrasive grains constitute a single layer, and in which a lower portion of each abrasive grain is embedded in the vitrified bond layer while an upper portion of each abrasive grain is not covered by the vitrified bond layer and protrudes from the vitrified bond layer. Further, the present method makes it possible to arrange the abrasive grains on the support body in various patterns. By suitably arranging the abrasive grains on the support body depending upon its purpose, it is possible to manufacture the vitrified bond tool having the abrasive-grains-holding capacity and the polishing capacity suitable for the purpose.

The present inventors proposed, in JP-A-10-193266, the vitrified bond tool characterized by including the support body, and the abrasive grains cooperating with each other to form an abrasive layer which is bonded by the vitrified bond to the support body. The present inventors have now accomplished the present invention, as a result of a further study, which provides the vitrified bond tool wherein the positions of the abrasive grains relative to the working surface of the support body are more exactly controllable two-dimensionally or three-dimensionally.

According to a first preferred form of the second aspect of the invention, the method further comprises the steps of: (iv) forming a backing layer which includes a vitrified bond, on the working surface of the support body; and (v) forming a pattern layer which includes a vitrified bond, in a predetermined pattern on the backing layer.

According to a second preferred form of the second aspect of the invention, the method further comprises the step of (vi) applying one of a paste and a slurry including a vitrified bond, on the working surface of the support body, for thereby forming a coating layer which surrounds each of the abrasive grains on the working surface of the support body.

The vitrified bond tool defined above in the fifth preferred form of the first aspect of the invention can be manufactured according to a method comprising the steps of: (vii) mixing the first and second abrasive grains with each other with a predetermined ratio of the number of the second abrasive grains to the number of the first abrasive grains; (viii) printing an abrasive-grains-adhering paste on the dressing surface, such that the pattern layer is formed of the abrasive-grains-adhering paste, on the dressing surface, in a dotted pattern consisting of a plurality of dots each having a diameter which is smaller than an average diameter of the first abrasive grains and which is larger than 30% of the average diameter of the first abrasive grains; (ix) sprinkling the first and second abrasive grains over the pattern layer formed on the dressing surface, so that ones of the first and second abrasive grains adhere to the pattern layer; (x) removing the others of the first and second abrasive grains which are not bonded to the pattern layer; and (xi) firing the pattern layer and the above-described ones of the first and second abrasive grains, so that the above-described ones of the first and second abrasive grains are held by the vitrified bond layer, so as to be fixed relative to the dressing surface of the support body.

According to the present method, the mixture of the first and second abrasive grains are sprinkled over the pattern layer which is formed on the dressing surface, in the dotted pattern consisting of the plurality of dots each having the diameter which is smaller than the average diameter of the first abrasive grains and which is larger than 30% of the average diameter of the first abrasive grains, so that ones of the first and second abrasive grains adhere to the pattern layer. The others of the first and second abrasive grains which do not adhere to the pattern layer are removed, and then the pattern layer and the adhering ones of the first and second abrasive grains are fired in the firing step, so that the adhering ones of the first and second abrasive grains are held by the vitrified bond layer, so as to be fixed relative to the dressing surface of the support body.

In the vitrified bond tool manufactured according to the present method, the first abrasive grains are held by the vitrified bond layer so as to be fixed relative to the dressing surface and are spaced apart from each other, while the second abrasive grains are held by the vitrified bond layer so as to be fixed relative to the dressing surface and are mingled together with each other such that the second abrasive grains are positioned between the first abrasive grains and are spaced apart from the first abrasive grains. Since at least the surface layer which is partially constituted by the dressing surface is made of the inorganic material, there is no risk of effluence of a metallic component even if a strong-acid fluid is used as the polishing fluid. Since the second abrasive grains whose average diameter is smaller than the average diameter of the first abrasive grains are positioned to be spaced apart from each other or to be spaced apart from the first abrasive grains, each of the second abrasive grains is bonded at an increased area of a surface thereof to the vitrified bond layer with a sufficiently large bonding strength. Further, the presence of the second abrasive grains between the first abrasive grains on the vitrified bond layer prevent the vitrified bond layer from being brought in contact with the polishing pad, thereby avoiding breakage of the vitrified bond layer.

The abrasive-grains-adhering paste may be, preferably, a slurry liquid having a high degree of viscosity, and includes an inorganic-bonding-agent powder which is dispersed in an organic solvent, water or other solvent, and further includes, as needed, a dispersing agent serving to restrain agglomeration of the inorganic-bonding-agent powder, a thickener serving to increase the viscosity of the abrasive-grains-adhering paste for facilitating the printing of the paste on the dressing surface, and a caking agent serving to bond the inorganic-bonding-agent powder to the substrate when the abrasive-grains-adhering paste is dried. It is noted that the dispersing agent, thickener and caking agent are dissipated at the firing step.

Preferably, the present method may further include the step of applying an inorganic-bonding-agent paste on the entirety of the dressing surface of the support body, before the abrasive-grains-adhering paste is printed. In this inorganic-bonding-agent applying step, the inorganic-bonding-agent paste is applied onto the dressing surface of the support body with a sufficiently large amount thereof which permits the first abrasive grains to be bonded to the support body with a sufficiently large bonding strength. Thus, the abrasive-grains-adhering paste is printed with a thickness thereof not so large as where this inorganic-bonding-agent applying step is not implemented, namely, where the first and second abrasive grains have to be fixed to the support body by only the abrasive-grains-adhering paste. In other words, where this inorganic-bonding-agent applying step is implemented before the abrasive-grains-adhering paste is printed, the thickness of the abrasive-grains-adhering paste no longer has to be so large, as long as the thickness of the printed abrasive-grains-adhering paste is sufficiently large for permitting the first and second abrasive grains to merely adhere to the abrasive-grains-adhering paste. Therefore, the operation for printing the abrasive-grains-adhering paste is facilitated without a risk of dripping of the dots of the dotted pattern of the abrasive-grains-adhering paste, which dripping would be caused where the thickness of the printed abrasive-grains-adhering paste is very large.

The dots of the pattern layer are arranged on the dressing surface, preferably, with a density of the dots being constant over the entirety of the dressing surface such that the number of the dots per unit area is constant over the entirety of the dressing surface. This arrangement is effective to substantially equalize loads applied to the respective first abrasive grains, to each other, thereby increasing the polishing efficiency and preventing removal of the first abrasive grains.

Each of the dots preferably has a diameter corresponding to 30–70% of the average diameter of the first abrasive grains, so that each one of the first abrasive grains adheres to the corresponding one of the dots when the abrasive grains are sprinkled over the pattern layer formed on the dressing surface.

BRIEF DESCRIPTION OF THE DRAWINGS

The above objects, features and advantages of the present invention will be better understood by reading the following detailed description of presently preferred embodiments of the invention, when considered in connection with the accompanying drawings, in which:

FIGS. 7(*c*) and (*d*) are microphotographs showing surfaces of the abrasive grains of the vitrified bond tool of Example 1 of the this invention, which were taken in perspective with magnification of ×50 and ×200, respectively;

FIG. 7(*e*) is a microphotograph showing fracture surfaces of the abrasive grains of the vitrified bond tool of Example 1 of the this invention, which was taken with magnification of ×250;

FIG. 7(*f*) is a microphotograph showing interfaces between the abrasive grains and the vitrified bond tool of Example 1 of the this invention, which was taken with magnification of ×3000;

DETAILED DESCRIPTION OF THE PREFERRED EMBODIMENTS

Figure 1A:
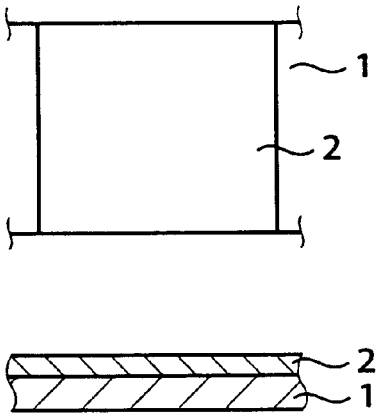
FIGS. 1(*a*)–(*d*) are views showing a process of manufacturing a vitrified bond tool of a first embodiment of this invention.
Figure 1B:
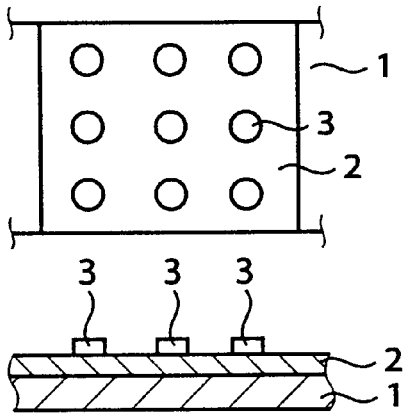
Figure 1C:
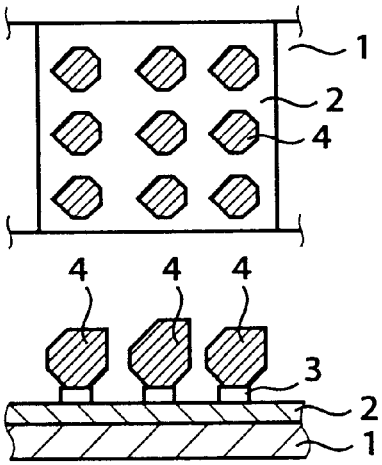
Figure 1D:
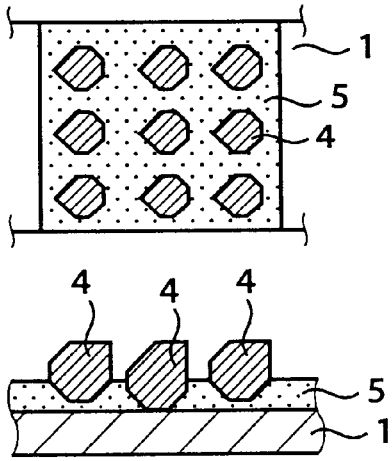

Referring first to FIGS. 1(*a*)–(*d*), there will be described a process of manufacturing a vitrified bond tool constructed according to a first embodiment of this invention. It is noted that each of FIGS. 1(*a*)–(*d*) has a plane view and a cross sectional view of the vitrified bond tool in its respective upper and lower parts.

(1) A paste including a vitrified bond is printed on the entirety of a working surface of a support body 1 so as to form a backing layer 2 having a predetermined thickness on the surface of the support body 1, as shown in FIG. 1(*a*). The printing operation is repeated until the backing layer 2 has the predetermined constant thickness. That is, a multi-layer printing operation is executed. The backing layer 2 may be formed also by spraying the paste on the working surface, in place of printing the paste on the working surface of the support body 1. It is noted that the above-described working surface may be interpreted to correspond to a dressing surface when the tool is used as a dressing tool, and correspond to a grinding or polishing surface when the tool is used as a grinding or polishing tool.

(2) The backing layer 2 is dried so as to be solidified to a certain extent.

(3) Another paste including a vitrified bond is printed in a predetermined pattern, e.g., a dotted pattern on the backing layer 2. That is, the paste is printed on the backing layer 2 by using suitable masking means, so as to form a pattern layer 3 having a consisting of a plurality of dots each of which has a predetermined size on the backing layer 2, as shown in FIG. 1(*b*). The dots are positioned relative to each other so as to be arranged in a lattice, at a predetermined pitch between the adjacent ones of the dots.

(4) A plurality of abrasive grains 4 are dispersed or sprinkled on the entirety of the working surface of the support body 1, before the pattern layer 3 is dried.

(5) The pattern layer 3 is dried to be solidified to a certain extent.

(6) Ones of the sprinkled abrasive grains 4, which are placed on the dots of the pattern layer 3, are fixed to pattern layer 3, when the pattern layer 3 is dried, so that the abrasive grains 4 also are arranged in the lattice, as shown in FIG. 1(*c*).

(7) The support body 1 is inverted or turned the working surface down, and then vibrated by using a vibration table or a small vibration device, so that the others of the abrasive grains 4, which are located between the dots of the pattern layer 3 and which are not bonded to the dots of the pattern layer 3, are dropped off or removed from the support body 1. The removed abrasive grains are recycled to be reutilized.

(8) The backing and pattern layers 2, 3 are fired under a firing condition which is predetermined depending upon kinds of ceramic or glass components included in the vitrified bond, so that a vitrified bond layer 5 is formed on the support body 1.

In the above-described process of manufacturing the vitrified bond tool of the first embodiment of the invention, the above-described masking means used for printing the paste or slurry in the predetermined pattern may be, for example, a stainless mesh screen which has a wire network defining the predetermined pattern, or a metal mask which has holes formed therethrough and cooperating with each other to defining the predetermined pattern. By using such suitable masking means, it is possible to easily form the pattern layer 3 according to the predetermined pattern, thereby providing a high degree of freedom in controlling or determining the number, density, distribution and arrangement of the abrasive gains 4 bonded to the pattern layer 3, depending upon a required dressing or grinding performance of the vitrified bond tool. In other words, it is possible to easily position abrasive portions and non-abrasive portions in desired portions of the working surface of the support body 1, while preventing undesirable agglomeration of the abrasive grains 4 in a local portion of the working surface of the support body 1.

For assuring arrangement of the abrasive grains 4 in the dotted pattern, each of the above-described dots has a size or diameter of preferably 25–80% or more preferably 30–70% of the average size or diameter of the abrasive grains 4, for thereby preventing two or more of the abrasive grains 4 from being bonded to each one of the dots, namely, preventing undesirable agglomeration of the abrasive grains 4.

The thickness of the paste, which is printed or sprayed on the support body 1, is suitably determined such that the abrasive grains 4 are not covered at upper portions thereof by the vitrified bond layer 5 which is formed in the firing step. If the upper portions of the abrasive grains 4 protrude from the vitrified bond layer 5 after the firing step, the vitrified bond tool does not have to be subjected to a truing operation, prior to an initial use thereof. That is, the vitrified bond tool exhibits an expected grinding performance even in the initial use without the truing operation. It is possible to control a distance over which each of the abrasive grains 4 is displaced or sunk into the vitrified bond layer 5, by controlling the thickness of the paste. In other words, force for holding the abrasive grains 4 can be adjusted by controlling the thickness of the paste.

Where the paste is printed on the support body 1, the thickness of the paste may be controlled by controlling the viscosity of the paste, the printing condition and the number of the printing operations. Where the slurry is sprayed on the support body 1 by using a spraying device, the thickness of the slurry may be controlled by controlling the viscosity of the slurry, the movement speed of the spraying device and the number of the spraying operations.

The paste or slurry preferably may include a ceramic bond which is dispersed in an organic solvent or an inorganic solvent such as water. The paste or slurry may further include a dispersing agent which serves to prevent agglomeration of components of the ceramic bond, a caking agent which serves to increase the capacity of holding the abrasive grains 4 when the paste or slurry is dried, and other additives.

Figure 2A:
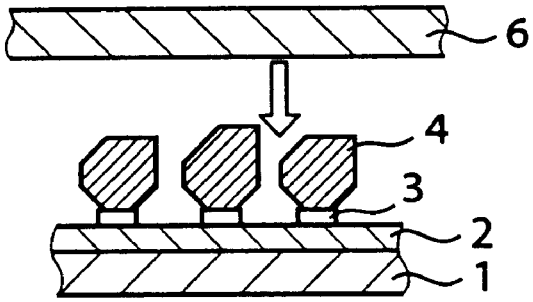
FIGS. 2(*a*)–(*b*) are views showing steps of equalizing protruding distances of abrasive grains in the vitrified bond tool of the first embodiment of the invention.
Figure 2B:
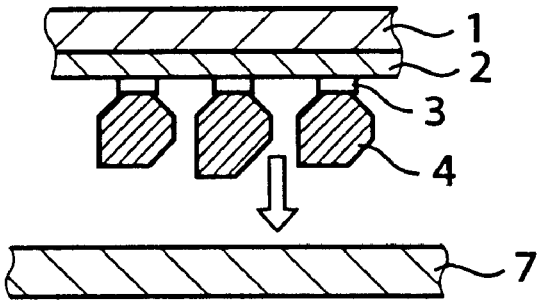
Figure 3A:
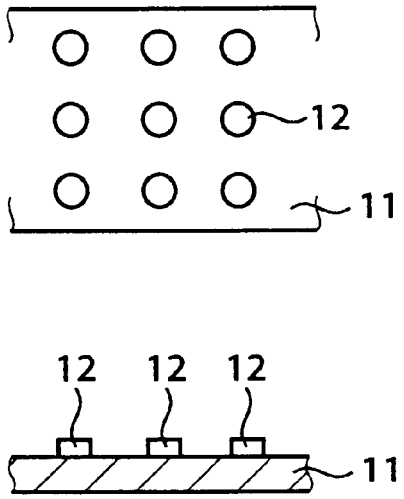
FIGS. 3(*a*)–(*d*) are views showing a process of manufacturing a vitrified bond tool of a second embodiment of this invention.
Figure 3B:
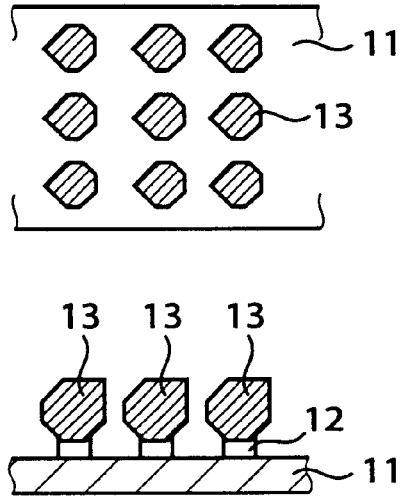
Figure 3C:
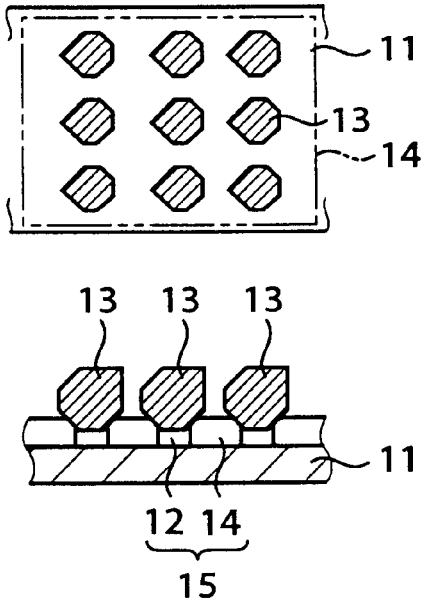
Figure 3D:
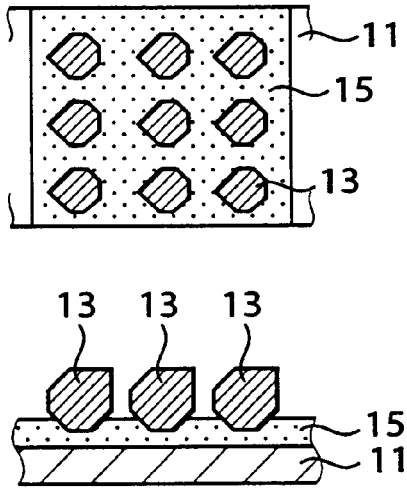
Figure 4A:
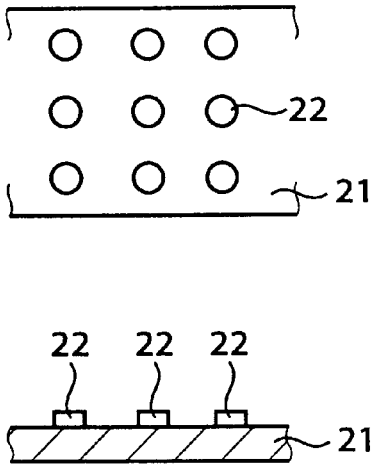
FIGS. 4(*a*)–(*d*) are views showing a process of manufacturing a vitrified bond tool of a third embodiment of this invention.
Figure 4B:
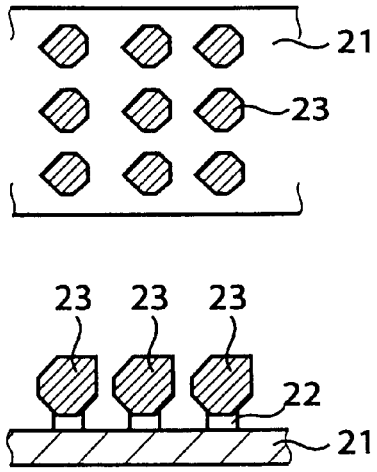
Figure 4C:
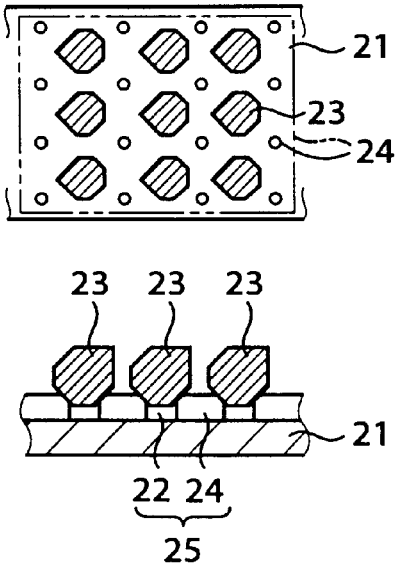
Figure 4D:
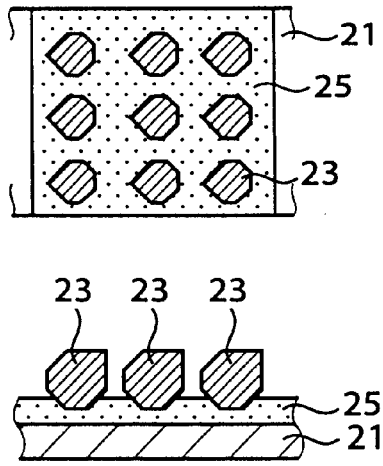

In the above-described process of manufacturing the vitrified bond tools of the invention, ones of the abrasive grains 4 each having a comparatively large size are displaced or sunk into the vitrified bond layer 5 over a comparatively large distance due to its comparatively large weight, while ones of the abrasive grains 4 each having a comparatively small size are displaced or sunk into the vitrified bond layer 5 over a comparatively small distance due to its comparatively small distance, in the firing step in which the pattern layer 3 and the backing layer 2 are melt so as to form the vitrified bond layer 5. Accordingly, the distances over which the respective abrasive grains 4 protrude from the vitrified bond layer 5 are substantially equalized to each other, so that the vitrified bond tool provides a stable grinding force at the initial use even without a truing operation thereto. For further equalizing the protruding distances of the abrasive grains 4 with each other, a weight 6 in the form of an alumina base plate may be used to put on the abrasive grains 4 at the firing step, or alternatively, the support body 1 may be inverted or turned its upside down so as to be then put on a surface plate 7 in the firing step, as shown in FIGS. 2(*a*) and (*b*). It is noted that each of the weight 6 and the surface plate 7 corresponds to a flat plate.

The abrasive grains 4 are positioned relative to each other such that an average distance between centers of the adjacent ones of the abrasive grains 4 is not smaller than 1.5 times as large as an average diameter of the abrasive grains 4, or more preferably, such that the average distance is 1.8–10 times as large as the average diameter. This arrangement prevents agglomeration of the abrasive grains 4, thereby minimizing clogging on the working surface of the support body 1 and improving the sharpness on the working surface of the support body 1. Thus, since all of the abrasive grains 4 sufficiently function to dress, grind or polish the subject, it is possible to reduce the number of the abrasive grains 4 to be used for the vitrified bond tool.

The abrasive grains 4 protrude from the vitrified bond layer 5, such that a distance over which each of the abrasive grains 4 protrudes from a surface of the vitrified bond layer 5 corresponds to 20–70% of a diameter of the abrasive grain 4. At the same time, the abrasive grains 4 are partially embedded in the vitrified bond layer 5, such that a distance over which each of the abrasive grains 4 is embedded in the vitrified bond layer 5 in a direction of the thickness of the layer 5 corresponds to 30% or more of the average diameter of the abrasive grains 4. Such a positional relationship between the abrasive grains 4 and the vitrified bond layer 5 is established by suitably controlling the thickness of the pattern layer 3 and the thickness of the backing layer 2. If the protruding distance of each abrasive grain 4 is too large, the abrasive grains 4 are easily removed from the vitrified bond layer 5 when the vitrified bond tool is used as a dressing tool. If the protruding distance is too small, on the other hand, the dressing capacity of the vitrified bond tool is reduced.

The support body 1 is made of a material consisting of at least one of alumina, mullite, silicon nitride, silicon carbide, zirconia and other ceramic material which has sufficiently high degrees of strength and toughness for serving as a tool.

The vitrified bond included in the paste includes at least one of borosilicate glass, crystallized glass, quartz glass, alumina, alumina nitride, silicon nitride, mullite, zirconia and other ceramic material. The vitrified bond is preferably glassy, so as to be sufficiently sintered at a low temperature. The vitrified bond preferably has a specific gravity lower than that of the abrasive grains 4 and a softening point not larger than 750° C., so that the vitrified bond layer 5 is melt so as to permit the abrasive grains 4 to be sunk into the vitrified bond layer 5, for thereby holding the abrasive grains 4.

One preferable composition of the vitrified bond is indicated as follows:

$SiO_2$: 40–70 wt %, $Al_2O_3$: 10–20 wt %, $B_2O_3$: 10–20 wt %,

RO: 2–10 wt % (R is at least one kind of metal which is selected from alkaline earth metals), and $R_2O$: 2–10 wt % (R is at least one kind of metal which is selected from alkaline metals).

The vitrified bond tool of the present invention, in which the support body 1 and the vitrified bond layer 5 are made of respective ceramic materials which are chemically stable, does not suffer from effluence of a metallic component from the tool, for example, where the tool is used to dress a polishing pad in the above-described CMP operation even if the polishing fluid is a strong-acid or strong-alkaline fluid.

The abrasive grains 4 may consist of selected at least one kind of diamond, CBN and other super abrasive grains, and/or selected at least one kind of alumina (such as molten alumina and sol-gel sintered abrasive grains), silicon carbide, silicon nitride and other generally available abrasive grains.

The materials of the support body 1, the vitrified bond layer 5 and the abrasive grains 4 are suitably determined in view of a required dressing or grinding performance and also their respective thermal expansion coefficients. For preventing cracking of the tool in the firing step of the manufacturing process, it is desirable that the thermal expansion coefficients of the support body 1, the vitrified bond layer 5 and the abrasive grains 4 are substantially equal to each other. That is, the difference therebetween is preferably not larger than $3\times10^{-6}$, more preferably not larger than $2\times10^{-6}$, and still more preferably not larger than $1\times10^{-6}$.

Referring next to FIGS. 3(*a*)–(*d*), there will be described a process of manufacturing a vitrified bond tool constructed according to a second embodiment of this invention. It is noted that each of FIGS. 3(*a*)–(*d*) has a plane view and a cross sectional view of the vitrified bond tool in its respective upper and lower parts.

(1) A paste including a vitrified bond is printed in a predetermined pattern, e.g., in a dotted pattern, on a working surface of a support body 11. That is, the paste is printed on the working surface of the support body 11 by using suitable masking means, so as to form a pattern layer 12 consisting of a plurality of dots each of which has a predetermined size on the working surface of the support body 11, as shown in FIG. 2(*a*). The dots are positioned relative to each other so as to be arranged in a lattice, at a predetermined pitch between the adjacent ones of the dots.

(2) A plurality of abrasive grains 13 are dispersed or sprinkled on the entirety of the working surface of the support body 11, before the pattern layer 12 is dried.

(3) The pattern layer 12 is dried to be solidified to a certain extent.

(4) Ones of the sprinkled abrasive grains 13, which are disposed on the dots of the pattern layer 12, are fixed to the pattern layer 12, as the pattern layer 12 is dried, so that the abrasive grains 13 also are arranged in the lattice, as shown in FIG. 2(*b*).

(5) The support body 11 is inverted or turned the working surface down, and then vibrated by using a vibration table or a small vibration device, so that the others of the abrasive grains 13, which are located between the dots of the pattern layer 12 and which are not bonded to the dots of the pattern layer 12, are dropped off or removed from the support body 11. The removed abrasive grains are recycled to be reutilized.

(6) A paste including a vitrified bond is printed on the working surface of the support body 11, so that a coating layer 14 is formed to surround each of the abrasive grains 13 on the working surface of the support body 11.

(7) The pattern-printed and coating layers 12, 14 are fired under a firing condition which is predetermined depending upon kinds of ceramic or glass components included in the vitrified bond, so that a vitrified bond layer 15 is formed on the support body 11.

In the above process of manufacturing the vitrified bond tool of the second embodiment of this invention, the pattern layer 12 and the abrasive grains 13 held by the layer 12 may be once fired before the formation of the coating layer 14, and then the pattern layer 12 and the abrasive grains 13, together with the coating layer 14, may be fired again after the formation of the coating layer 14.

A positional relationship between the abrasive grains 13 and the vitrified bond layer 15 is controllable by suitably controlling the thickness of the pattern layer 12 and the thickness of the coating layer 14.

Referring next to FIGS. 4(*a*)–(*d*), there will be described a process of manufacturing a vitrified bond tool constructed according to a third embodiment of this invention. It is noted that each of FIGS. 4(*a*)–(*d*) has a plane view and a cross sectional view of the vitrified bond tool in its respective upper and lower parts.

(1) A paste including a vitrified bond is printed in a predetermined pattern, e.g., in a dotted pattern, on a working surface of a support body 21. That is, the paste is printed on the working surface of the support body 21 by using suitable masking means, so as to form a pattern layer 22 consisting of a plurality of dots each of which has a predetermined size on the working surface of the support body 21, as shown in FIG. 4(*a*). The dots are positioned relative to each other so as to be arranged in a lattice, at a predetermined pitch between the adjacent ones of the dots.

(2) A plurality of abrasive grains 23 are dispersed or sprinkled on the entirety of the working surface of the support body 21, before the pattern layer 22 is dried.

(3) The pattern layer 22 is dried to be solidified to a certain extent.

(4) Ones of the sprinkled abrasive grains 23, which are disposed on the dots of the pattern layer 22, are fixed to the pattern layer 22, as the pattern layer 22 is dried, so that the abrasive grains 23 also are arranged in the lattice, as shown in FIG. 4(*b*).

(5) The support body 21 is inverted or turned the working surface down, and then vibrated by using a vibration table or a small vibration device, so that the others of the abrasive grains 23, which are located between the dots of the pattern layer 22 and which are not bonded to the dots of the pattern layer 22, are dropped off or removed from the support body 21. The removed abrasive grains are recycled to be reutilized.

(6) A slurry including a vitrified bond is sprayed on the working surface of the support body 21, so that a coating layer 24 is formed to surround each of the abrasive grains 23 on the working surface of the support body 21.

(7) The pattern-printed and coating layers 22, 24 are fired under a firing condition which is predetermined depending upon kinds of ceramic or glass components included in the vitrified bond, so that a vitrified bond layer 25 is formed on the support body 21.

Figure 5A:
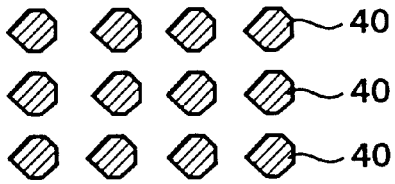
FIGS. 5(*a*)–(*c*) are views showing some examples of arrangement of the abrasive grains in the vitrified bond tool of this invention.
Figure 5B:
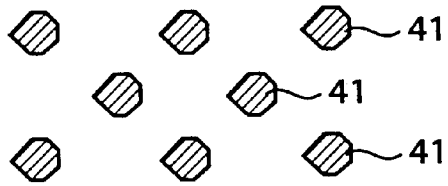
Figure 5C:
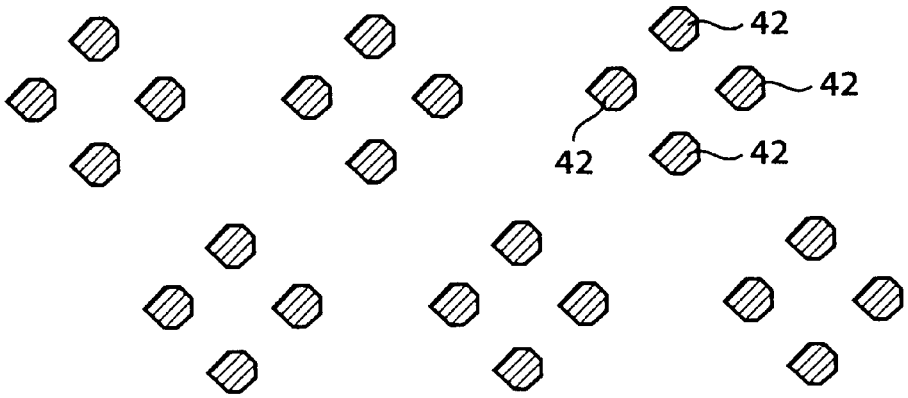

FIGS. 5(*a*)–(*c*) show some dotted patterns of the arrangements of the abrasive grains in the vitrified bond tool of the present invention. The abrasive grains 4, 13, 23 in the above-described embodiments are arranged in a lattice on the support body, like abrasive grains 40 as shown in FIG. 5(*a*). However, the abrasive grains may be arranged in a staggered or zigzag manner, like abrasive grains 41 as shown in FIG. 5(*b*), or may be arranged as abrasive grains 42 of FIG. 5(*c*). The abrasive grains 42 are arranged in a dotted pattern consisting of a plurality of groups each of which consists of a predetermined number of the abrasive grains 42. The plurality of groups are arranged in a lattice or zigzag manner or other dotted pattern.

Figure 6A:
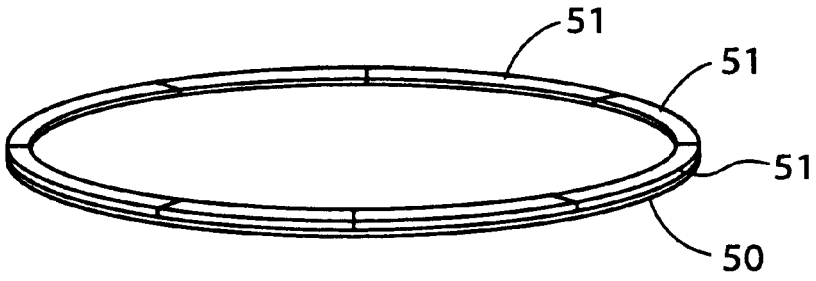
FIGS. 6(*a*)–(*b*) are views showing some examples of the vitrified bond tool of this invention.
Figure 6B:
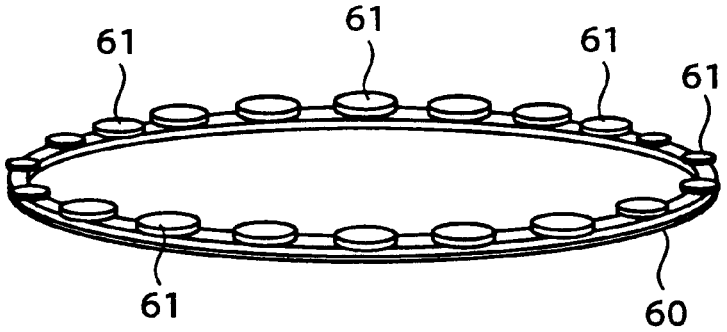
Figure 7A:
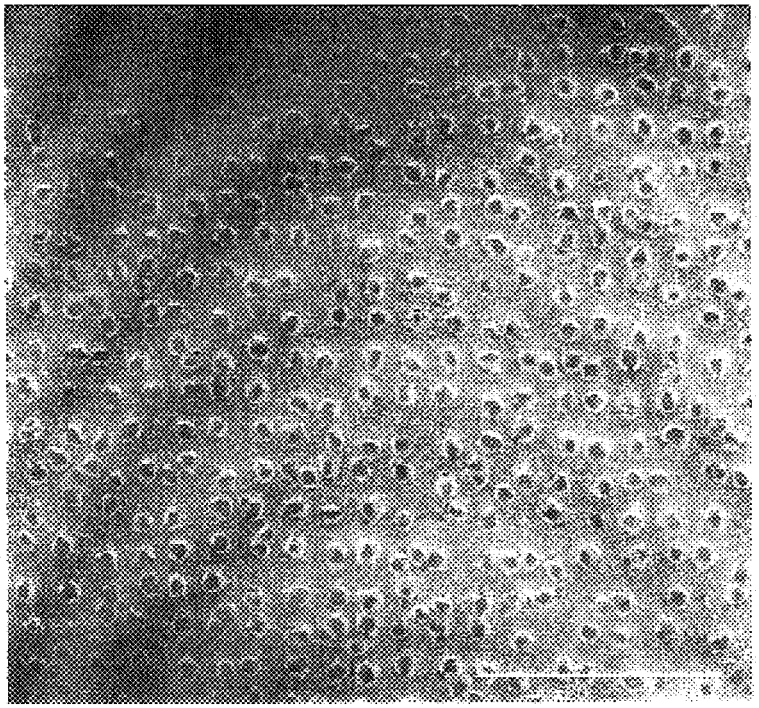
FIGS. 7(*a*) and (*b*) are microphotographs showing surfaces of the abrasive grains of a vitrified bond tool of Example 1 of the this invention, which were taken with magnification of ×25 and ×100, respectively.
Figure 7B:
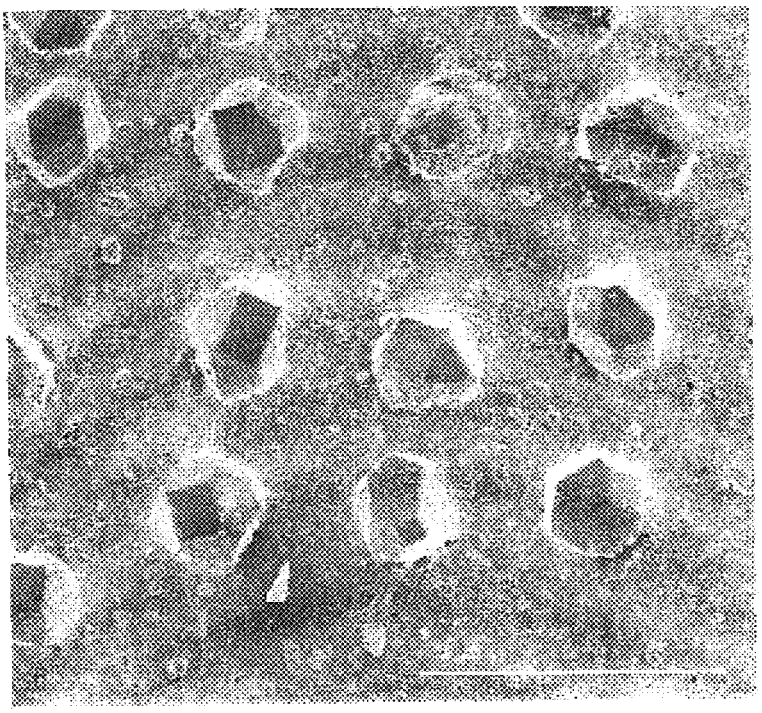
Figure 7C:
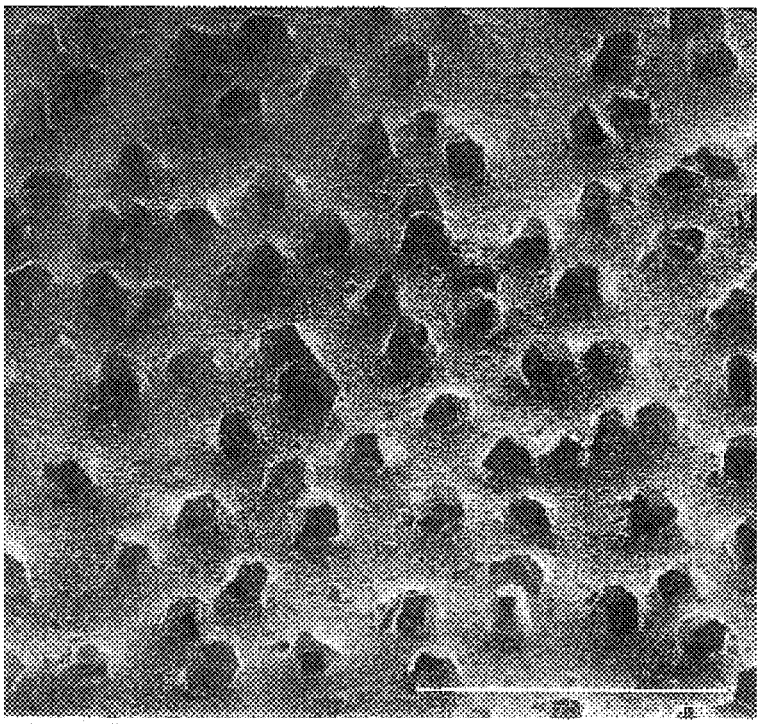
Figure 7D:
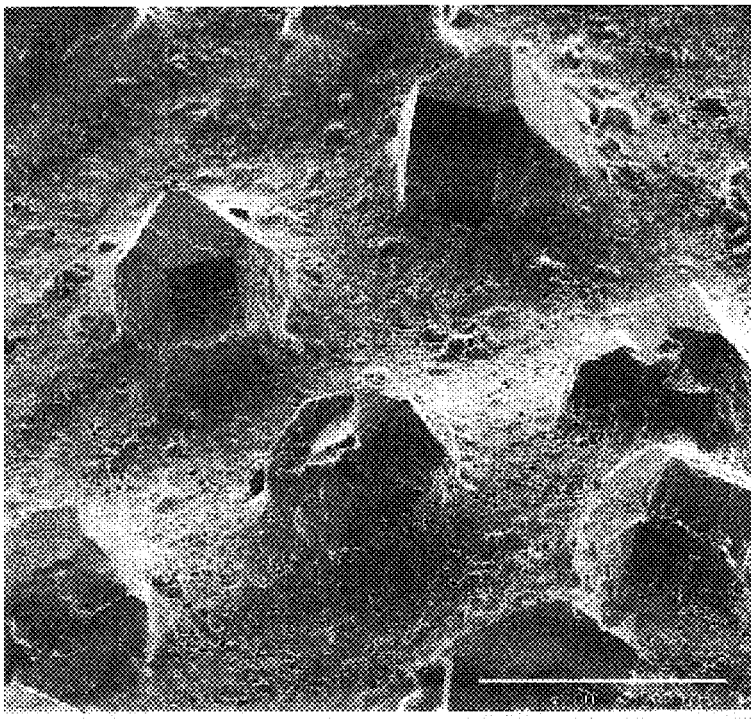
Figure 7E:
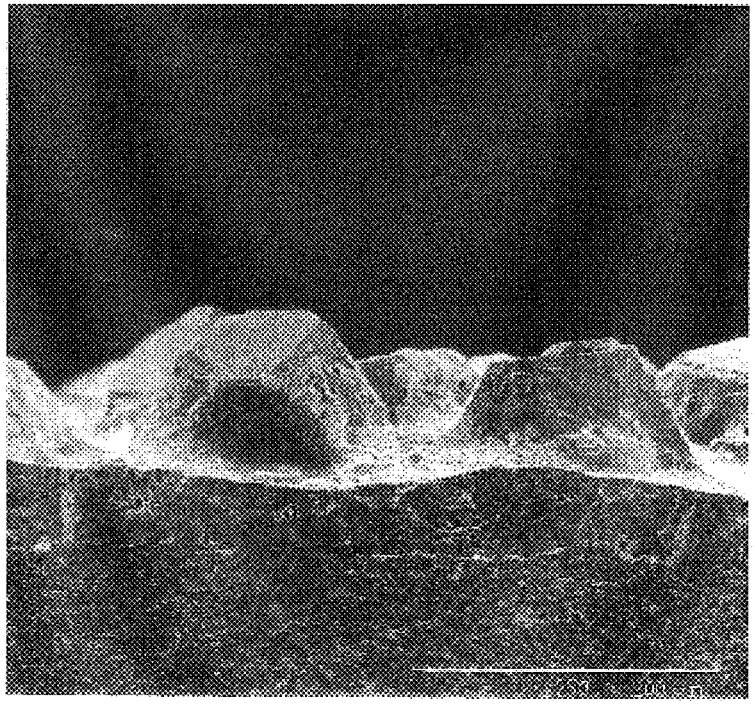
Figure 7F:
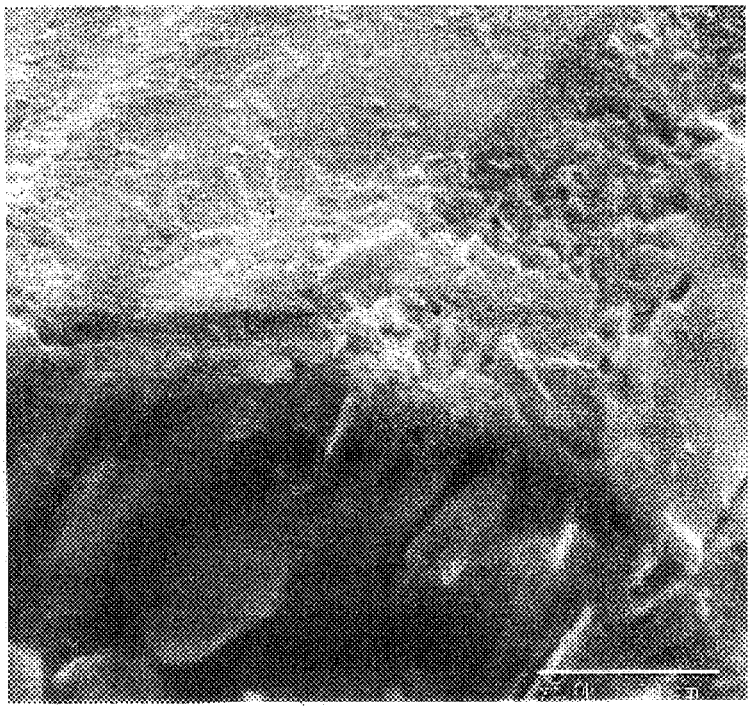

FIGS. 6(*a*) and (*b*) show some examples of the support body of the vitrified bond tools of the present invention. FIG. 6(*a*) shows a plurality of arcuate-shaped support bodies 51 bonded to an annular base 50. The arcuate-shaped support bodies 51 are arranged in a circumferential direction of the annular base 50, and are adjacent to each other in the circumferential direction. On each of the arcuate-shaped support bodies 51, the abrasive grains are disposed and held by the vitrified bond layer. FIG. 6(*b*) shows a plurality of disk-shaped support bodies 61 bonded to an annular base 60. The disk-shaped support bodies 61 are arranged in a circumferential direction of the annular base 60, and are adjacent to each other in the circumferential direction. On each of the disk-shaped support bodies 62, the abrasive grains are disposed and held by the vitrified bond layer.

EXAMPLES

To further clarify the concept of the present invention, some examples of the invention will be described. It is to be understood that the invention is not limited to the details of the illustrated examples, but may be embodied with various changes, modifications and improvements, which may occur to those skilled in the art without departing from the scope of the invention defined in the attached claims.

Example 1

Initially, the generally disk-shaped support body 1 was prepared. The disk-shaped support body 1 was made of silicon nitride, and had a diameter of 100 mm and a thickness of 5 mm. The disk-shaped support body 1 had, in its outer peripheral portion, a protruding portion which was divided by eight slits into eight protrusions. These eight protrusions were arranged in the circumferential direction of the support body 1 at an angular pitch of 45°, and each of them had a width of 4 mm and a height of 1 mm. Each of the eight slits, which divided the protruding portion into the eight protrusions, had a width of 5 mm and a depth of 1 mm.

A paste including a borosilicate glass was printed on the entirety of a surface of each of the eight protrusions of the support body 1. The printing operation was repeated six times, so that a backing layer 2 having a predetermined thickness, for example, of 150 $\mu$m is formed on the entirety of the surface of the protrusion of the support body 1, as shown in FIG. 1(*a*). The support body 1 and the backing layer 2 are then dried for about 5 minutes at a temperature of 120° C. in an oven.

Another paste including a borosilicate glass was pattern-printed on the backing layer 2 by using suitable masking means, so as to form a pattern layer 3 consisting of a plurality of dots each of which had a diameter of 100 $\mu$m, as shown in FIG. 1(*b*). The dots were positioned relative to each other so as to be arranged in a lattice, at a pitch of 300 $\mu$m between the adjacent ones of the dots.

Diamond abrasive grains 4 of #100/#120 were sprinkled on each protrusion of the support body 1, by using a sieve of about #100, such that each one of the diamond abrasive grains 4 was held on the corresponding one of the dots of the pattern layer 3. The support body 1 thus holding the diamond abrasive grains 4 was dried for about 5 minutes at a temperature of 120° C. in an oven. The support body 1 was then set on a vibration table, so that the support body 1 was vibrated for removing surplus ones of the diamond abrasive grains 4 from the support body 1. The removed abrasive grains were recycled.

The support body 1 was fired or burned at a temperature of 900° C. in a nitrogen atmosphere. In this firing step, the temperature was raised to 900° C. for 24 hours, kept at 900° C. for three hours, and lowered from 900° C. for 24 hours. By thus firing the support body 1, a vitrified bond layer(glass layer) 5 was formed on each protrusion of the support body 1, so that a vitrified bond tool in which the abrasive grains 4 were held in the vitrified bond layer 5 was obtained. The abrasive grains 4 protruded from the vitrified bond layer 5, such that an average amount of the distances over which the abrasive grains 4 protruded from the surface of the vitrified bond layer 5 was 65 μm. The ratio of this average protruding distance to the average diameter of the abrasive grains 4 was 43% (=65/151×100).

There will be described a microscopic construction of the vitrified bond tool of Example 1 which was constructed as described above. FIGS. 7(*a*)–(*f*) are photographs of the vitrified bond tool which were taken by a microscope. FIGS. 7(*a*) and (*b*) are a photograph with magnification of 25 (×25) and a photograph with magnification of 100 (×100), respectively, both of which are frontal views showing surfaces of the abrasive grains. FIGS. 7(*c*) and (*d*) are a photograph with magnification of 50 (×50) and a photograph with magnification of 200 (×200), respectively, both of which are oblique views showing the surfaces of the abrasive grains. FIG. 7(*e*) is a photograph with magnification of 250 (×250) which is a view showing fracture surfaces of this vitrified bond tool. FIG. 7(*f*) is a photograph with magnification of 3000 (×3000) which is a view showing an interface between the abrasive grain and the vitrified bond.

FIG. 7(*a*) shows that the diamond abrasive grains 4 cooperate with each other to form a single abrasive layer, which is bonded to the support body 1 by the vitrified bond.

FIG. 7(*b*) shows that the diamond abrasive grains 4 are independent form each other, and are positioned relative to each other so as to be arranged in a dotted pattern or in a lattice, at a predetermined spacing interval therebetween.

FIGS. 7(*c*)–(*f*) show that the diamond abrasive grains 4 are held by the vitrified bond layer 5 so as to be fixed relative to the support body 1, such that each of the abrasive grains 4 is partially embedded in the vitrified bond layer 5 which has an average thickness of about 100 μm. FIG. 7(*e*) shows that the distances over which the respective abrasive grains 4 protrude from the surface of the vitrified bond layer 5 are substantially equal to each other. The average distance between centers of adjacent two of the abrasive grains 4 is about 300 μm, which is equal to the pitch of the dots of the pattern layer 3, while the average spacing interval between adjacent two of the abrasive grains 4 is about 150 μm. That is, the distance between centers of adjacent two of the abrasive grains 4 is generally about twice as large as the average diameter of the abrasive grains 4.

Where the diamond abrasive grains 4 are of #100/#120 as in Example 1, the average diameter of the diamond abrasive grains 4 is 151 μm, and the ratio of ones of the abrasive grains 4 having a diameter of not smaller than 165 μm to the entirety of the abrasive grains 4 is not larger than 7% (see *Abridged Table-FEPA Standard for Superabrasive Grain Sizes*, 1997). Since the distances over which the respective abrasive grains 4 protrude from the surface of the vitrified bond layer 5 are substantially equal to each other, the distance between the surface of the support body 1 and ones of the abrasive grains 4 having the diameter of 151 μm corresponds to about 10% [(165−151)÷151×100=9.2] of the average diameter of the abrasive grains 4, on the assumption that ones of the abrasive grains 4 having the diameter of 165 μm are brought into contact with the surface of the support body 1. Thus, portions of the vitrified bond layer 5 which are interposed between the surface of the support body 1 and the above-described ones of the abrasive grains 4 having the average diameter have a thickness corresponding to about 10% of the average diameter of the abrasive grains 4. In other words, portions of the vitrified bond layer 5 which are interposed between the surface of the support body 1 and at least more than a half of the abrasive grains 4 have a thickness corresponding to about 10% of the average diameter of the abrasive grains 4.

There will be described steps of further equalizing the distances over which the respective abrasive grains 4 protrude from the vitrified bond layer 5, with reference to FIGS. 3(*a*) and (*b*).

FIG. 3(*a*) shows a step in which a weight 6 is used to be put on the diamond abrasive grains 4 held on the dots of the pattern layer 3, so that ones of the abrasive grains 4 protruding more than the other abrasive grains 4 are displaced or sunk toward the support body 1.

FIG. 3(*b*) shows a step in which the support body 1 is inverted or turned its upside down, and the support body 1 is then put on a surface plate 7, so that ones of the abrasive grains 4 protruding more than the other abrasive grains 4 are displaced or sunk toward the support body 1.

With implementation of the step of FIG. 3(*a*) or the step of FIG. 3(*b*), the distances over which the respective abrasive grains 4 protrude from the vitrified bond layer 5 are further equalized to each other. It is also preferable that one of these steps are implemented simultaneously with the firing step, namely, the firing step is implemented with the weight 6 being put on the abrasive grains 4, or with the inverted support body 1 being put on the surface plate 7.

Comparative Example 1

Comparative Example 1 in the form of a diamond tool was produced. The body of this diamond tool had a shape identical to that of the support body 1 of Example 1, but was made of SUS304. Diamond abrasive grains of #100/#120 were electro-deposited on each protrusions of the support body with Ni metal. The protruding distance of the abrasive grains were 50 μm.

Example 2

Initially, a generally disk-shaped support body 11 was prepared. The disk-shaped support body 11 was made of the same material as the support body 1 of Example 1, and was identical in shape to the support body 1 of Example 1. A paste including a borosilicate glass was pattern-printed on each protrusion of the support body 11 by using suitable masking means, so as to form a pattern layer 12 consisting of a plurality of dots each of which had a diameter of 100 μm, as shown in FIG. 3(*a*). The dots were positioned relative to each other so as to be arranged in a lattice, at a pitch of 300 μm between the adjacent ones of the dots.

Diamond abrasive grains 13 of #100/#120 were sprinkled on each protrusion of the support body 11, by using a sieve of about #100, such that each one of the diamond abrasive grains 13 was held on the corresponding one of the dots of the pattern layer 12, as shown in FIG. 3(*b*). The support body 11 thus holding the diamond abrasive grains 13 was dried for about 5 minutes at a temperature of 120° C. in an oven. The support body 11 was then set on a vibration table, so that the support body 11 was vibrated for removing surplus ones of the diamond abrasive grains 13 from the support body 11. The removed abrasive grains were recycled.

Another paste including a borosilicate glass was printed twice on each protrusion of the support body 11, so that a coating layer 14 is formed to surround each of the abrasive grains 13 on the protrusion of the support body 11, as shown in FIG. 3(*c*). The support body 11 was dried for about 5 minutes at a temperature of 120° C. in an oven, and then fired or burned at a temperature of 900° C. in a nitrogen atmosphere. In this firing step, the temperature was raised to 900° C. for 24 hours, kept at 900° C. for three hours, and lowered from 900° C. for 48 hours.

By thus firing the support body 11, a vitrified bond layer(glass layer) 15 was formed on each protrusion of the support body 11, as shown in FIG. 3(*d*), so that a vitrified bond tool in which the abrasive grains 13 were held in the vitrified bond layer 15 was obtained. The abrasive grains 13 protruded from the vitrified bond layer 15, such that an average amount of the distances over which the abrasive grains 13 protruded from the surface of the vitrified bond layer 15 was 65 μm. The ratio of this average protruding distance to the average diameter of the abrasive grains 13 was 43% (=65/151×100).

Example 3

Initially, a generally disk-shaped support body 21 was prepared. The disk-shaped support body 21 was made of the same material as the support body 1 of Example 1, and was identical in shape to the support body 1 of Example 1. A paste including a borosilicate glass was pattern-printed on each protrusion of the support body 21 by using suitable masking means, so as to form a pattern layer 22 consisting of a plurality of dots each of which had a diameter of 100 μm, as shown in FIG. 4(*a*). The dots were positioned relative to each other so as to be arranged in a lattice, at a pitch of 300 μm between the adjacent ones of the dots.

Diamond abrasive grains 23 of #100/#120 were sprinkled on each protrusion of the support body 21, by using a sieve of about #100, such that each one of the diamond abrasive grains 23 was held on the corresponding one of the dots of the pattern layer 22, as shown in FIG. 4(*b*). The support body 21 thus holding the diamond abrasive grains 23 was dried for about 5 minutes at a temperature of 120° C. in an oven. The support body 21 was then set on a vibration table, so that the support body 21 was vibrated for removing surplus ones of the diamond abrasive grains 23 from the support body 21. The removed abrasive grains were recycled.

A slurry including a borosilicate glass was sprayed three times on each protrusion of the support body 21, so that a coating layer 24 is formed to surround each of the abrasive grains 23 on the protrusion of the support body 21, as shown in FIG. 4(*c*). The support body 21 was dried for about 5 minutes at a temperature of 120° C. in an oven, and then fired or burned at a temperature of 900° C. in a nitrogen atmosphere. In this firing step, the temperature was raised to 900° C. for 24 hours, kept at 900° C. for three hours, and lowered from 900° C. for 48 hours.

By thus firing the support body 21, a vitrified bond layer(glass layer) 25 was formed on each protrusion of the support body 21, as shown in FIG. 4(*d*), so that a vitrified bond tool in which the abrasive grains 23 were held in the vitrified bond layer 25 was obtained. The abrasive grains 23 protruded from the vitrified bond layer 25, such that an average amount of the distances over which the abrasive grains 23 protruded from the surface of the vitrified bond layer 25 was 60 μm. The ratio of this average protruding distance to the average diameter of the abrasive grains 23 was 40% (=60/151×100).

Example 4

A vitrified bond tool of Example 4 was produced according to a process similar to that of Example 3 as shown in FIGS. 4(*a*)–(*d*). Initially, a generally disk-shaped support body was prepared. This disk-shaped support body was identical in shape with the support body 21 of Example 3, but was made of an alumina. A paste including an alumina was pattern-printed on each protrusion of the support body by using suitable masking means, so as to form a pattern layer consisting of a plurality of dots each of which had a diameter of 100 μm. The dots were positioned relative to each other so as to be arranged in a lattice, at a pitch of 300 μm between the adjacent ones of the dots.

Alumina abrasive grains of #100/#120 were sprinkled on each protrusion of the support body, by using a sieve of about #100, such that each one of the alumina abrasive grains was held on the corresponding one of the dots of the pattern layer. The support body thus holding the alumina abrasive grains was dried for about 5 minutes at a temperature of 120° C. in an oven. The support body was then set on a vibration table, so that the support body was vibrated for removing surplus ones of the alumina abrasive grains from the support body. The removed abrasive grains were recycled.

A slurry including an alumina was sprayed three times on each protrusion of the support body, so that a coating layer is formed to surround each of the abrasive grains on the protrusion of the support body. The support body was dried for about 5 minutes at a temperature of 120° C. in an oven, and then fired or burned at a temperature of 1450° C. in the atmospheric air. In this firing step, the temperature was raised to 1450° C. for 18 hours, kept at 1450° C. for two hours, and lowered from 1450° C. for 36 hours.

By thus firing the support body, a vitrified bond layer was formed on each protrusion of the support body, so that the vitrified bond tool in which the alumina abrasive grains were held in the vitrified bond layer was obtained. The alumina abrasive grains protruded from the vitrified bond layer, such that an average amount of the distances over which the alumina abrasive grains protruded from the surface of the vitrified bond layer was 55 μm. The ratio of this average protruding distance to the average diameter of the abrasive grains was 36% (=55/151×100). It is noted that the average amount of the protruding distance was calculated on the assumption that the alumina abrasive grains had an average diameter substantially equal to the average diameter of the diamond abrasive grains which were used in Examples 1–3.

Example 5

A vitrified bond tool of Example 5 was produced according to a process similar to that of Example 3 as shown in FIGS. 4(*a*)–(*d*). Initially, a generally disk-shaped support body was prepared. This disk-shaped support body was identical in shape with the support body 1 of Example 1, and was made of the same material as Example 1. A silicon nitride was pattern-printed on each protrusion of the support body made of a silicon nitride, by using suitable masking means, so as to form a pattern layer consisting of a plurality of dots each of which had a diameter of 100 μm. The dots were positioned relative to each other so as to be arranged in a lattice, at a pitch of 300 μm between the adjacent ones of the dots.

Silicon carbide abrasive grains of #100/#120 were sprinkled on each protrusion of the support body, by using a sieve of about #100, such that each one of the silicon carbide abrasive grains was held on the corresponding one of the dots of the pattern layer. The support body thus holding the silicon carbide abrasive grains was dried for about 5 minutes at a temperature of 120° C. in an oven. The support body was then set on a vibration table, so that the support body was vibrated for removing surplus ones of the abrasive grains from the support body. The removed abrasive grains were recycled.

A slurry including a silicon nitride was sprayed twice on each protrusion of the support body, so that a coating layer is formed to surround each of the silicon carbide abrasive grains on the protrusion of the support body. The support body was dried for about 1 hour at a temperature of 550° C. in an oven, and then fired or burned at a temperature of 1600° C. in a nitrogen atmosphere. In this firing step, the temperature was raised to 1600° C. for 15 hours, kept at 1600° C. for three hours, and lowered from 1600° C. for 6 hours.

By thus firing the support body, a vitrified bond layer was formed on each protrusion of the support body, so that the vitrified bond tool in which the silicon carbide abrasive grains were held in the vitrified bond layer was obtained. The silicon carbide abrasive grains protruded from the vitrified bond layer, such that an average amount of the distances over which the silicon carbide abrasive grains protruded from the surface of the vitrified bond layer was 60 μm. The ratio of this average protruding distance to the average diameter of the abrasive grains was 40% (=60/151×100). It is noted that the average amount of the protruding distance was calculated on the assumption that the silicon carbide abrasive grains had an average diameter substantially equal to the average diameter of the diamond abrasive grains which were used in Examples 1–3.

Evaluation Test 1

Each of the vitrified bond tools of Examples 1–5 and Comparative Example 1 was tested for dressing a urethane pad which is used in a chemical mechanical polishing(CMP) of a semiconductor wafer including a metallic layer.

Each of the tools was first immersed in a strong-acid solvent of pH2 for one week, and then taken out of the solvent and washed by water. After being washed, each of the tools was used to dress the urethane pad(n=5). After the dressing operation by each tool, evaluations were made as to a polishing rate of the urethane pad and as to whether or not the semiconductor wafer could be scratched due to removal of the abrasive grains from the vitrified bond tool during the polishing operation for 180 minutes. For seeing if the semiconductor wafer would be scratched or not, a glass plate was forced onto the urethane pad during the polishing operation. It was judged that the wafer would be scratched if there was confirmed a scratch on the glass plate.

As indicated in Table 1, the vitrified bond tools of Examples 1–5 exhibited excellent performances, and the semiconductor wafer would not suffer from being scratched due to removal of the abrasive grains where the tools of Examples 1–5 were used for dressing the urethane pad. On the other hand, the semiconductor wafer would suffer from being scratched where the diamond tool of Comparative Example 1 was used for dressing the urethane pad, and it is therefore assumed that some abrasive grains were removed from the tool of Comparative Example 1.

TABLE 1

| | Material of Support body | Material of Bond | Abrasive grains | Dressing performance | Scratch |
|---|---|---|---|---|---|
| Example 1 | Silicon nitride | Borosilicate glass | Diamond | Good | No |
| Example 2 | Silicon nitride | Borosilicate glass | Diamond | Good | No |
| Example 3 | Silicon nitride | Borosilicate glass | Diamond | Good | No |
| Example 4 | Alumina | Alumina | Alumina | Good | No |
| Example 5 | Silicon nitride | Silicon nitride | Silicon carbide | Good | No |
| Comparative Example 1 | SUS304 | Ni | Diamond | Good | Yes |

There will be described vitrified bond tools of Examples 6–9, each of which was produced according to a process including the step of further equalizing the distances over which the respective abrasive grains protrude from the vitrified bond layer, as shown in FIG. 2(*a*).

Example 6

The vitrified bond tool of Example 6 was produced according to a process similar to that of the vitrified bond tool of Example 1, except that the weight 6 in the form of a square base plate made of an alumna and having a size of 120 mm×120 mm was put on the abrasive grains, as shown in FIG. 2(*a*), in the firing step. The average amount of the protruding distances of the abrasive grains after the firing step was 65 μm.

Example 7

The vitrified bond tool of Example 7 was produced according to a process similar to that of the vitrified bond tool of Example 1, except that (a) a slurry including a borosilicate glass was sprayed three times, in place of being printed, on the surface of each protrusion of the support body, for the formation of the backing layer having the thickness of 150 μm, and that (b) the weight 6 in the form of a square base plate made of an alumna and having a size of 120 mm×120 mm was put on the abrasive grains in the firing step. The average amount of the protruding distances of the abrasive grains after the firing step was 60 μm.

Example 8

The vitrified bond tool of Example 8 was produced according to a process similar to that of the vitrified bond tool of Example 4, except that (a) the backing layer having the thickness of 150 μm is formed, in place of the formation of the coating layer, by printing six times a paste including an alumina on the surface of each protrusion of the support body, and the pattern layer is then formed after the formation of the backing layer, and that (b) the weight 6 in the form of a square base plate made of an alumna and having a size of 120 mm×120 mm was put on the abrasive grains in the firing step. The average amount of the protruding distances of the abrasive grains after the firing step was 55 μm.

Example 9

The vitrified bond tool of Example 9 was produced according to a process similar to that of the vitrified bond tool of Example 5, except that (a) the backing layer is formed, in place of the formation of the coating layer, by printing six times a paste including a silicon nitride on the surface of each protrusion of the support body, and the pattern layer is then formed after the formation of the backing layer, and that (b) the weight 6 in the form of a square base plate made of an alumna and having a size of 120 mm×120 mm was put on the abrasive grains in the firing step. The average amount of the protruding distances of the abrasive grains after the firing step was 60 $\mu$m.

Evaluation Test 2

Each of the vitrified bond tools of Examples 6–9 was tested, as in the above-described Evaluation Test 1.

As indicated in Table 2, the vitrified bond tools of Examples 6–9 exhibited excellent performances, and the semiconductor wafer did not suffer from being scratched due to removal of the abrasive grains where the vitrified bond tools of Examples 6–9 were used for dressing the urethane pad.

TABLE 2

| | Material of Support body | Material of Bond | Abrasive grains | Dressing performance | Scratch |
|---|---|---|---|---|---|
| Example 6 | Silicon nitride | Borosilicate glass | Diamond | Good | No |
| Example 7 | Silicon nitride | Borosilicate glass | Diamond | Good | No |
| Example 8 | Alumina | Alumina | Alumina | Good | No |
| Example 9 | Silicon nitride | Silicon nitride | Silicon carbide | Good | No |

Figure 8:
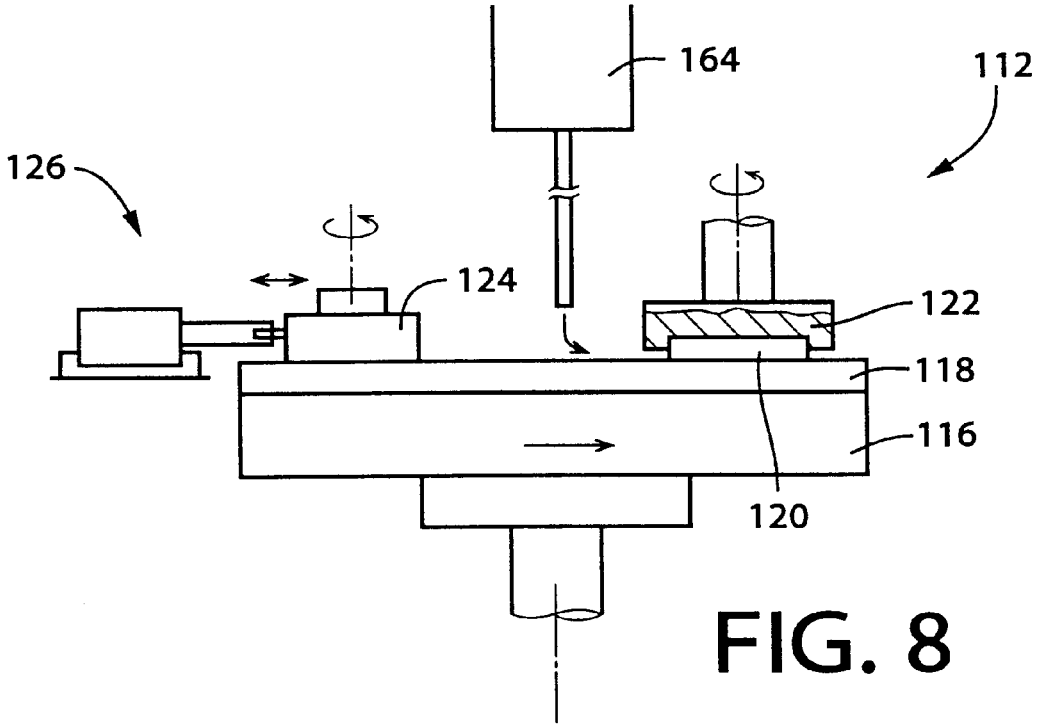
FIG. 8 is a view schematically illustrating a surface polishing machine in which a dressing tool of this invention is installed.
Figure 9:
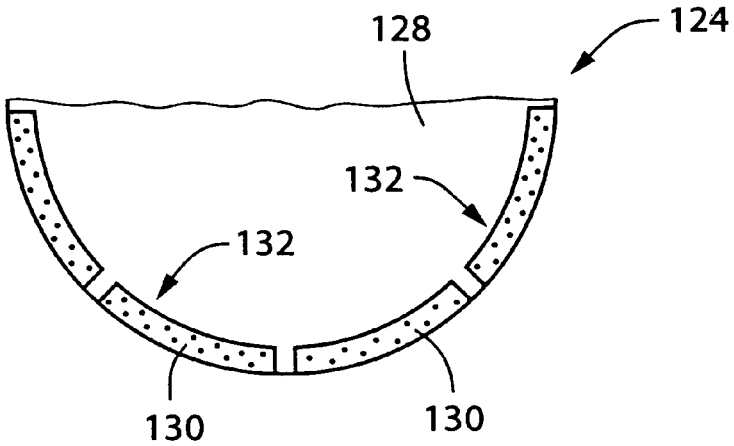
FIG. 9 is a view showing a part of the dressing tool of this invention.

Referring next to FIGS. 8–16, there will be described a disk-shaped dressing tool 124 constructed according to a fourth embodiment of the present invention. FIG. 8 is a view schematically showing a surface polishing machine 112 in which the dressing tool 124 is installed. FIG. 9 is a view showing a lower side face of the dressing tool 124.

As shown in FIG. 8, the surface polishing machine 112 includes a circular-shaped polishing table 116 which is rotated about its axis by a driving device(not shown). The polishing table 116 has a flat upper surface, a diameter of about 600–1000 mm and a high degree of rigidity. To the flat upper surface of the polishing table 116, there is attached a polishing pad 118 which includes a foamable urethane resin, non-woven fabric cloth or other abrasive cloth. The surface polishing machine 112 further includes a work holding member 122 for holding a workpiece 120 in the form of a semiconductor wafer. The work holding member 122 has, in its lower face, a recess into which the workpiece 120 is fittable, so that the workpiece 120 is held in sliding contact with the polishing pad 118. The work holding member 122 is rotatable about its axis perpendicular to an upper surface of the polishing table 116, so as to be rotated about the axis by a driving device (not shown), or by a torque generated by the sliding contact of the workpiece 120 with the polishing pad 118 which is rotated together with the polishing table 116. The surface polishing machine 112 further includes a dressing device 126, by which the dressing tool 124 is held in sliding contact with the polishing pad 118 and is rotated about its axis perpendicular to the upper surface of the polishing table 116. The dressing tool 124 is reciprocated in a radial direction of the polishing table 116, or is revolved in a predetermined orbit, while the dressing tool 124 is rotated about its axis and is forced onto the polishing pad 118 with a predetermined load.

The dressing tool 124 is suitably used for CMP operation, and includes a disk-shaped support body 128 having a diameter of 100 mm and a thickness of 10 mm, for example. The support body 128 is made of a suitable ceramic material which has a high degree of chemical stability and a sufficiently high degree of toughness for serving as a dressing tool. Such a ceramic material may be a sintered body of an inorganic material selected from alumina $Al_2O_3$, silicon nitride $Si_3N_4$, silicon carbide SiC, zirconia and mullite, or a glass having a high melting point. The support body 128 has eight protruding portions 132 which are formed in a radially outer end portion of the lower side face thereof and which protrude downwardly in the axial direction of the support body 128. The protruding portions 132, each having an arcuate shape as viewed in FIG. 9, are angularly spaced apart from each other in the circumferential direction of the support body 128. Each protruding portion 132 has a predetermined height as measured in the axial direction of the support body 128 and a predetermined width as measured in the radial direction of the support body 128. The predetermined height and width of the protruding portion 132 may be about 1 mm and 5 mm, respectively, for example. The dressing tool 124 further includes dressing surfaces 130 each of which is disposed on a flat lower end face or axially distal end face of the corresponding protruding portions 132. These dressing surfaces 130 are brought into sliding contact with the polishing pad 118, for dressing the surface of the polishing pad 118 or eliminating clogging on the surface of the polishing pad 118.

Figure 14:
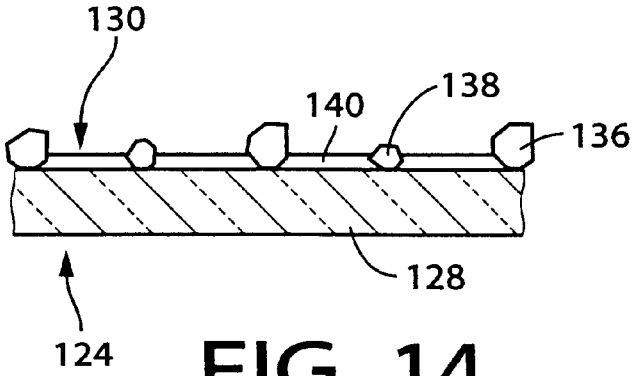
FIG. 14 is a view after a firing step of the process of FIG. 10 has been implemented.

On the dressing surface 130, as shown in FIG. 14, there are disposed a multiplicity of first abrasive grains 136 and a multiplicity of second abrasive grains 138 whose average diameter is smaller than the average diameter of the first abrasive grains 136. The first abrasive grains 136 are positioned to be spaced apart from each other, while the second abrasive grains 138 are mingled together with each other and are positioned to be spaced apart from the first abrasive grains 136. The first and second abrasive grains 136, 138 are held by a vitrified bond layer 140, so as to be fixed relative to the dressing surface 130 of the support body 130.

The first abrasive grains 136 are bonded to the dressing surface 130 such that an upper portion of each of the first abrasive grains 136 protrudes from the vitrified bond layer 140, by a predetermined protruding distance which corresponds to 20–70% of the diameter of each first abrasive grains 136. The vitrified bond layer 140 is made of a glass material which has been made melted, for example, in a firing step 160 as described below. For preventing cracking of the dressing surface 130, the difference between the abrasive grains 136, 138 and the vitrified bond layer 140 in terms of thermal expansion coefficient is not larger than $5\times10^{-6}$, preferably not larger than $4\times10^{-6}$, more preferably not larger than $3\times10^{-6}$. Similarly, the difference between the vitrified bond layer 140 and the support body 128 in terms of thermal expansion coefficient is not larger than $5\times10^{-6}$, preferably not larger than $4\times10^{-6}$, more preferably not larger than $3\times10^{-6}$. The vitrified bond layer 140 is made of a borosilicate glass, which includes at least $SiO_2$ and $B_2O_3$ such that the content of $SiO_2$ therein is 40–70 wt % and the content of $B_2O_3$ therein is 10–30 wt %. The chemical composition for the vitrified bond layer 140 may include, for example, 40–70 wt % of $SiO_2$, 0–20 wt % of $Al_2O_3$, 10–30 wt % of $B_2O_3$, 0–10 wt % of at least one kind of metal oxide RO which is selected from alkaline earth metals, and 0–10 wt % of at least one kind of metallic oxide $R_2O$ which is selected from alkaline metals.

Figure 10:
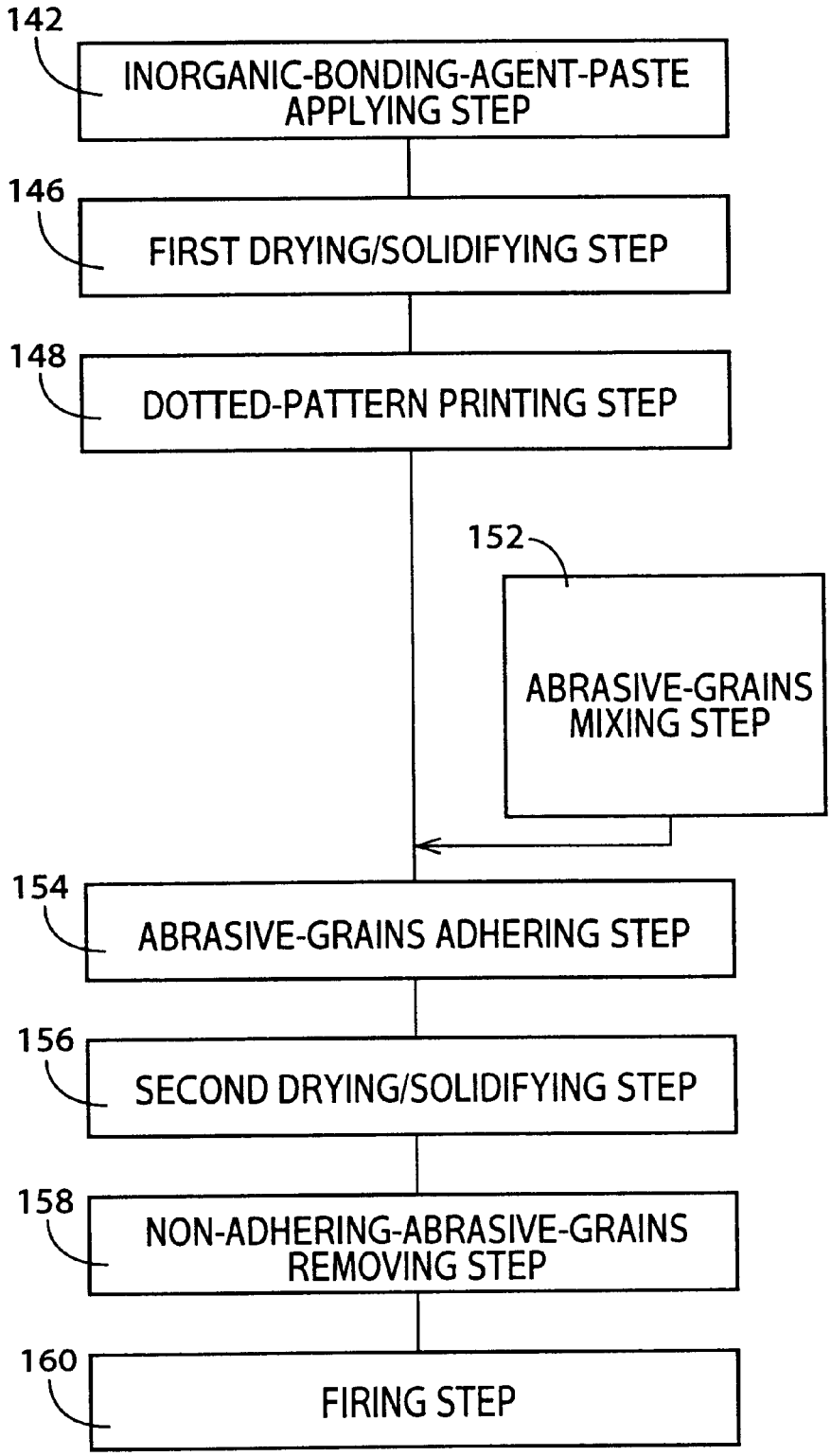
FIG. 10 is a flow chart illustrating a process of manufacturing the dressing tool of FIG. 9.

The dressing tool 124 may be produced, for example, according to a production process as shown in FIG. 10. In an inorganic-bonding-agent-paste applying step 142, an inorganic-bonding-agent past is applied to the entirety of the dressing surface 130, i.e., on the axially distal end surface of each protruding portion 132 on the lower side face of the support body 128, by screen-printing, spraying or dipping in several times, such that the applied paste forms a backing layer 144 having a sufficiently large thickness, for example, 150 μm, which thickness permits the first abrasive grains 136 to be bonded to the dressing surface 130 with a sufficiently high degree of bonding strength. The inorganic-bonding-agent paste forming the backing layer 144 is a fluid having a high degree of viscosity or a slurry-like fluid, and includes an organic solvent, water or other solvent in which a liquid resin and other substances are dissolved, and ceramic powder which is dispersed in the solvent. This ceramic powder may be borosilicate glass, crystallized glass, silica glass, alumina, silicon nitride, silicon carbide, mullite, zirconia or other boding agent which is used for a vitrified grindstone. The ceramic powder has high degree of strength and toughness, and a fusing point lower than that of the support body 128 which is chemically stable.

The inorganic-bonding-agent paste may further include, as needed, a dispersing agent such as polyacrylic ammonium or phosphoric ester which serves to restrain agglomeration of the ceramic powder, a thickener such as polyethylene glycol which serves to increase the viscosity of the paste for facilitating the implementation of the above-described step 142, and a caking agent such as polyvinyl butyral or acrylic resin which serves to bond the ceramic powder to the substrate when the ceramic powder is dried. It is noted that the dispersing agent, thickener, caking agent are dissipated in the firing step 160.

Figure 11:
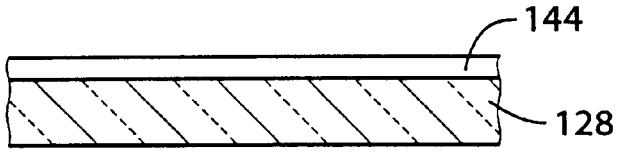
FIG. 11 is a view after an inorganic-bonding-agent-paste applying step and a first drying/solidifying of the process of FIG. 10 have been implemented.
Figure 12:
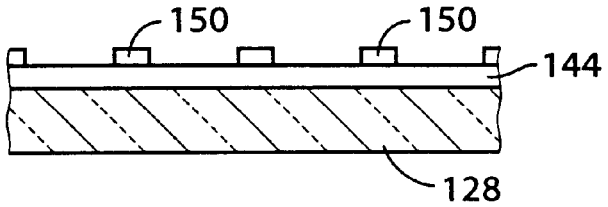
FIG. 12 is a view after a dotted-pattern printing step of the process of FIG. 10 has been implemented.

The paste applying step 142 is followed by a first drying/solidifying step 146 in which the inorganic-bonding-agent paste, which has been applied to the dressing surface 130, is heated at a temperature of 120° C. in an oven whereby the solvent included in the inorganic-bonding-agent paste is transpired into the air, so that the paste is dried and solidified into the backing layer 144, as shown in FIG. 11.

The first drying/solidifying step 146 is followed by a dot-pattern printing step 148 in which an abrasive-grains-adhering paste is printed on the backing layer 144 which has been solidified in the first drying/solidifying step, so as to from a pattern layer 150 in a dotted pattern consisting of a plurality of circular-shaped, viscous dots, which are evenly distributed over the entirety of the dressing surface 130 such that the number of the dots per unit area, or the density of the dots is constant over the entirety of the dressing surface 130. The abrasive-grains-adhering paste forming the pattern layer 150 serves to provisionally fix the first and second abrasive grains 136, 138 relative to the dressing surface 130, and includes an inorganic material powder and a liquid resin which is dispersed in a solvent, as the inorganic- bonding-agent paste forming the backing layer 144, so as to have high degrees of viscosity and adhesiveness. The abrasive-grains-adhering paste is screen-printed on the backing layer 144, by using a mesh, a metal mask or other masking means, such that the dots have a thickness of about 20 μm and are arranged along X-direction and Y-direction which are perpendicular to each other, with a constant spacing interval therebetween, as shown in FIG. 11. It is noted that each of the plurality of dots has a diameter as large as 30–70% of that of the first abrasive grain 136.

In an abrasive-grains mixing step 152, the first and second abrasive grains 136, 138 are mixed such that the ratio of the number of the second abrasive grains 138 to the number of the first abrasive grains 136 is 1–10, preferably 2–5. This mixing step 152 may be implemented prior to the other steps. Where diamond abrasive grains of #100/#120 (average diameter: 150 μm) are used as the first abrasive grains 136, for example, diamond abrasive grains of #140/#170 (average diameter: 110 μm) or alumina abrasive grains of #150/#180 (average diameter: 75 μm) are used as the second abrasive grains 138.

In an abrasive-grains adhering step 154, the mixture of the first and second abrasive grains 136, 138, which has been prepared in the abrasive-grains mixing step 152, are sprinkled over the dressing surface 130, on which the abrasive-grains-adhering paste has been printed in the dotted pattern in the dot-pattern printing step 148. The sprinkled mixture of the first and second abrasive grains 136, 138 do not adhere to the backing layer 144 which has been dried and solidified, but adhere to the dots of the abrasive-grains-adhering paste which has not been dried yet.

The abrasive-grains adhering step 154 is followed by a second drying step 156 in which the abrasive-grains-adhering paste is dried to be solidified into the pattern layer 150, in the same manner as in the first drying step 146. A non-adhering-abrasive-grains removing step 158 is then implemented to invert the support body 128 so as to turn the dressing surface 130 down, and then vibrate the support body 128, if needed, so that ones of the abrasive grains 136, 138, which are located between the dots of the pattern layer 150 and which do not adhere to the dots of the pattern layer 150, are dropped off or removed from the dressing surface 130 owing to the gravity and vibration, as shown in FIG. 13.

Figure 13:
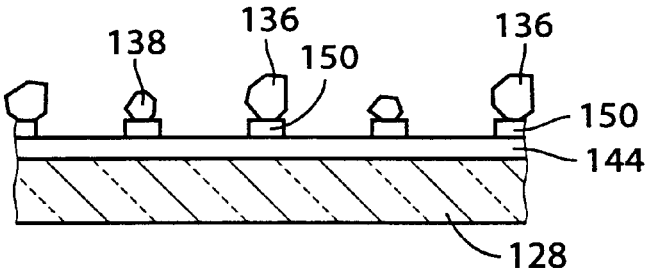
FIG. 13 is a view after an abrasive-grains adhering step, a second drying/solidifying step and a non-adhering-abrasive-grains removing step of the process of FIG. 10 have been implemented.

In the subsequent firing step 160, the assembly as shown in FIG. 13 is fired in a non-oxidizing atmosphere at a temperature of about 900° C., which is higher than the fusing point of the inorganic material powder included in the backing and pattern layers 144, 150 and is lower than the fusing point of the support body 128, so that the inorganic material powder is vitrified to form the vitrified bond layer 140 which constitutes a surface layer of the dressing surface 130. In the formation of the vitrified bond layer 140, the first and second abrasive grains 136, 138, which adheres to the pattern layer 150, are sunk or displaced downwardly relative to the support body 128 owing to their own weights, such that the first and second abrasive grains 136, 138 are brought into contact with or proximity to the surface of the support body 128. That is, the first and second abrasive grains 136, 138 are partially embedded in the vitrified bond layer 140, as shown in FIG. 14. When the temperature is lowered at the final stage of this firing step 160, the vitrified bond layer 140 is cooled to be solidified.

Figure 15:
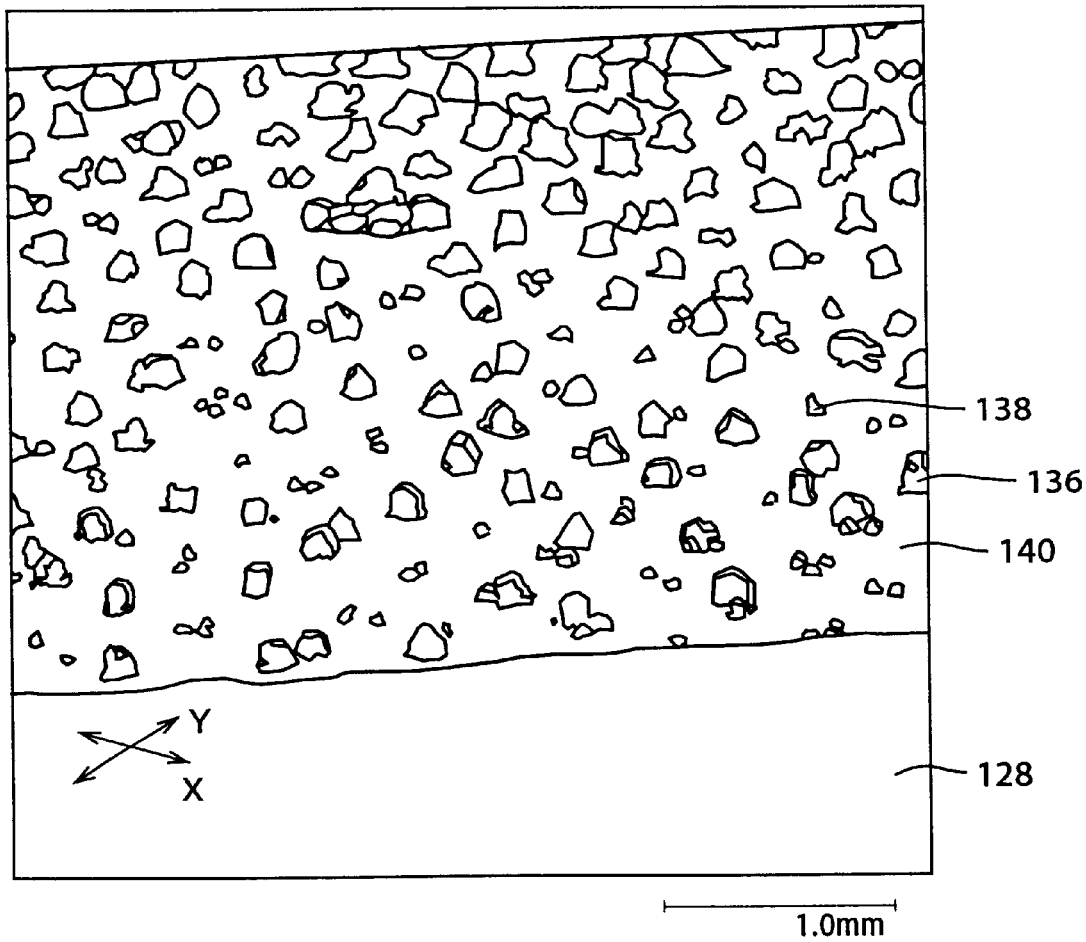
FIG. 15 is a view showing a microstructure of a dressing surface of the dressing tool which was actually produced according to the process of FIG. 10.
Figure 16:
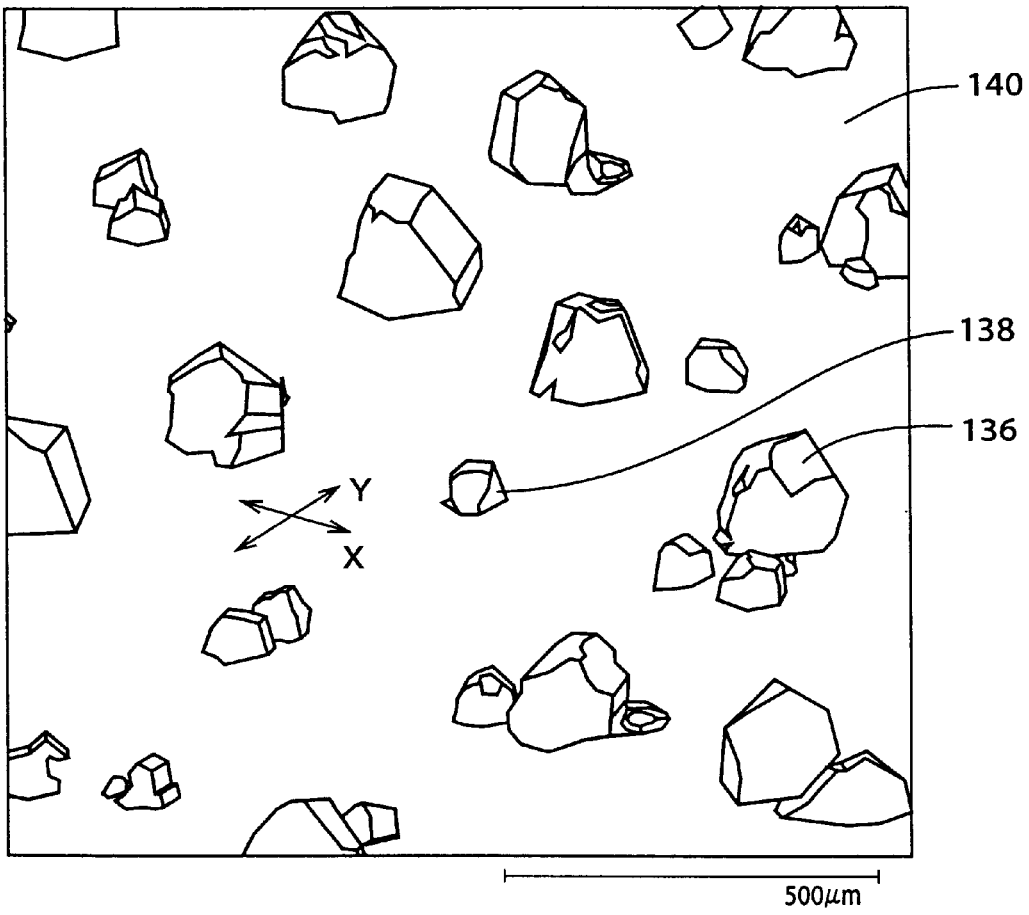
FIG. 16 is a view showing the dressing surface of the dressing tool, with a magnification larger than that of FIG. 15.

FIGS. 15 and 16 are microphotographs showing a portion of the dressing surface 130 of the dressing tool 124 which has been actually produced. These microphotographs were taken in perspective by an electron microscope. The length of the solid line in FIG. 15 corresponds to 1.0 mm, while the length of the solid line in FIG. 16 corresponds to 500 μm. As shown in FIGS. 15 and 16, all of the first abrasive grains 136 do not necessarily have to be spaced apart from each other, but some of the first abrasive grains 136 may be close to each other while most of them are spaced apart from each other. Further, one or ones of the second abrasive grains 138 does not necessarily have to be located between the adjacent ones of the first abrasive grains 136, as long as the first and second abrasive grains 136, 138 are mixed with a predetermined ratio therebetween. A small number (e.g. two or three) of the second abrasive grains 138 may be bonded, together with each other, to a single position in the vitrified bond layer 140.

In CMP operation, with the surface polishing machine 112, for flattening a surface of the semiconductor wafer 120 by eliminating a concavity or convexity (about 5–16 μm) of insulating films of LSI, the polishing table 116 and the work holding member 122 are rotated while a strong-acid, polishing slurry or fluid containing loose or free abrasive grains is supplied to the polishing pad 118. With the rotations of the polishing table 116 and the work holding member 122, the polishing pad 118 and the semiconductor wafer 120 are moved relative to each other with sliding contact therebetween, while the polishing pad 118 and the dressing tool 124 are moved relative to each other with sliding contact therebetween. The polishing pad 118 cooperates with the polishing fluid to chemically and mechanically polish the surface of the semiconductor wafer 120 for flattening the surface of the semiconductor wafer 120 with a high precision, while the dressing surface 130 of the dressing tool 124 dresses the polishing surface of the polishing pad 118 so as to eliminate clogging on the surface of the polishing pad 118, so that the polishing operation is efficiently and accurately performed with a high degree of operational stability.

There will be described experiments which were conducted by the present inventors. In the experiments, dressing tools of Example 10, Example 11 and Comparative Example 2 were produced according to respective processes as described below, so as to evaluate the dressing performances of the dressing tools and check if there was a cracking in a polished workpiece when they were used for a polishing operation under a polishing condition as described below.

Producing Processes

Example 10

An inorganic-bonding-agent paste containing borosilicate glass powders as a main component thereof was applied to the dressing surface 130 of the support body 128 by screen printing. The screen printing was repeated six times so that the applied inorganic-bonding-agent paste had a thickness of 150 μm. The applied inorganic-bonding-agent paste was then dried for about 5 minutes at a temperature of 120° C. in an oven, so that the backing layer 144 is formed of the inorganic-bonding-agent paste. The abrasive-grains-adhering paste is then screen-printed on the backing layer 144, in a dotted pattern consisting of a plurality of dots each of which had a diameter of 100 μm and which were positioned relative to each other at a pitch of 300 μm therebetween. The first abrasive grains 136 including the diamond abrasive grains of #100/#120 (grain size) and the second abrasive grains 138 including the diamond abrasive grains of #140/#170 (grain size) were mixed with each other such that the ratio of the number of the second abrasive grains 138 to the number of the first abrasive grains 136 is three. The mixture of the first and second abrasive grains 136, 138 was sprinkled on the dotted pattern, and the abrasive-grains-adhering paste was then dried for about 5 minutes at a temperature of 120° C. in an oven. After the abrasive-grains-adhering paste had been dried and solidified into the pattern layer 150, non-adhering ones of the abrasive grains 136, 138 were removed and recycled by using a vibration table. In the firing step, the support body 128 was fired or burned at a temperature of 900° C. in a nitrogen atmosphere, wherein the temperature was raised to 900° C. for 24 hours, kept at 900° C. for three hours, and lowered from 900° C. for 24 hours.

Example 11

The dressing tool of Example 11 was produced according to a producing process which was substantially identical to the above producing process of Example 10 except for the component of the second abrasive grains 138. That is, while the second abrasive grains 138 included the diamond abrasive grains of #140/#170 in Example 10, the second abrasive grains 138 included the alumina abrasive grains of #150/#180 in Example 11.

Comparative Example 2

The dressing tool of Comparative Example 2 was produced according to a producing process which was substantially identical to the above producing process of Example 10, except that the first abrasive grains 136 including the diamond abrasive grains of #100/#120, in place of the above-described mixture, was sprinkled on the dotted pattern.

Polishing Condition

The dressing tools of Examples 10, 11 and Comparative Example 2 were immersed in a strong-acid solution for one week, and then washed by water. By using these dressing tools, the semiconductor wafer 120 was polished in the surface polishing machine 112 having the polishing pad 118 made of a foamable polyurethane, with the same number of revolutions of the dressing tools and the same value of the load applied to the dressing tools. Table 3 indicates a polishing rate of the polishing pad 118, and whether or not the semiconductor wafer 120 was scratched due to removal of the abrasive grains or inorganic bonding agent during the polishing operation for 180 minutes. For seeing if the semiconductor wafer 120 was scratched or not, a glass plate was forced onto the polishing pad 118 during the polishing operation. It was judged that the semiconductor wafer 120 was scratched if there was confirmed a scratch on the glass plate. As indicated in Table 3, the semiconductor wafer 120 did not suffer from being scratched where the dressing tools of Examples 10 and 11 were used for dressing the polishing pad 118. On the other hand, the semiconductor wafer 120 suffered from being scratched where the dressing tool of Comparative Example 2 was used for dressing the polishing pad 118. The polishing rate of the polishing pad 118 was higher where the dressing tool of Example 11 was used, than where the dressing tool of Comparative Example 2 was used. The polishing rate of the polishing pad 118 was still higher where the dressing tool of Example 10 was used, than where the dressing tool of Example 11 was used.

TABLE 3

| Example | 1st abrasive grains | 2nd abrasive grains | Polishing rate | Scratch |
|---|---|---|---|---|
| Example 10 | Diamond #100 | Diamond #140 | 150 | No |
| Example 11 | Diamond #100 | Alumina #150 | 120 | No |
| Comparative Example 2 | Diamond #100 | — | 100 | Yes |

As described above, in the dressing tool 124 of the present invention, the first and second abrasive grains 136, 138 are held by the vitrified bond layer 140 to be fixed to the dressing surface 130, such that the first abrasive grains 136 are positioned to be spaced apart from each other, while the second abrasive grains 138 whose average diameter is smaller than that of the first abrasive grains 136 are mingled together with each other and are positioned to be spaced apart from the first abrasive grains 136. Since at least the surface layer which is partially constituted by the dressing surface 130 is made of the inorganic material, there is no risk of effluence of a metallic component even if a strong-acid fluid is used as the polishing fluid. Since the second abrasive grains 138 are positioned to be spaced apart from each other or to be spaced apart from the first abrasive grains 136, each of the second abrasive grains 138 is bonded at an increased area of a surface thereof to the vitrified bond layer 140 with a sufficiently large bonding strength. Further, the presence of the second abrasive grains 138 between the first abrasive grains 136 on the vitrified bond layer 140 prevent the vitrified bond layer 140 from being brought in contact with the polishing pad 118, thereby avoiding breakage of the vitrified bond layer 140.

According to the method of manufacturing the dressing tool 124 of this invention, the mixture of the first and second abrasive grains 136, 138 are sprinkled over the pattern layer 150 in the abrasive-grains adhering step 154, which layer has been formed, in the dotted-pattern printing step 148, on the dressing surface 130 in the dotted pattern consisting of the plurality of dots each having the diameter which is smaller than the average diameter of the first abrasive grains 136 and which is larger than 30% of the average diameter of the first abrasive grains 136, so that ones of the first and second abrasive grains 136, 138 adhere to the pattern layer 150. The others of the first and second abrasive grains 136, 138 which do not adhere to the pattern layer 150 are removed in the non-adhering-abrasive-grains removing step 158, and then the pattern layer 150 and the adhering ones of the first and second abrasive grains 136, 138 are fired in the-firing step 160, so that the adhering ones of the first and second abrasive grains 136, 138 are held by the vitrified bond layer 140, so as to be fixed relative to the dressing surface 130 of the support body 128.

In the dressing tool 124 produced as described above, the first and second abrasive grains 136, 138 are held by the vitrified bond layer 140 to be fixed to the dressing surface 130, such that the first abrasive grains 136 are positioned to be spaced apart from each other, while the second abrasive grains 138 whose average diameter is smaller than that of the first abrasive grains 136 are mingled together with each other and are positioned to be spaced apart from the first abrasive grains 136. Since at least the surface layer which is partially constituted by the dressing surface 130 is made of the inorganic material, there is no risk of effluence of a metallic component even if a strong-acid fluid is used as the polishing fluid. Since the second abrasive grains 138 are positioned to be spaced apart from each other or to be spaced apart from the first abrasive grains 136, each of the second abrasive grains 138 is bonded at an increased area of a surface thereof to the vitrified bond layer 140 with a sufficiently large bonding strength. Further, the presence of the second abrasive grains 138 between the first abrasive grains 136 on the vitrified bond layer 140 prevent the vitrified bond layer 140 from being brought in contact with the polishing pad 118, thereby avoiding breakage of the vitrified bond layer 140.

The support body 128 of the dressing tool 124 of the present embodiment is made of a suitable ceramic material which has a high degree of chemical stability and a sufficiently high degree of toughness for serving as a dressing tool. Such a ceramic material is selected among alumina $Al_2O_3$, silicon nitride $Si_3N_4$, silicon carbide SiC, zirconia, mullite or other sintered body of inorganic material or other glass having a high melting point. The vitrified bond layer 140 includes ceramic powder, such as borosilicate glass, crystallized glass, silica glass, alumina, silicon nitride, silicon carbide, mullite or zirconia, which has high degree of strength and toughness, and a fusing point lower than that of the support body 128 which is chemically stable. This construction prevents elusion or effluence of a metallic component into the polishing fluid, thereby eliminating a risk of contamination of the workpiece, and prevents removal of the first and second abrasive grains 136, 138 from the vitrified bond layer 140, thereby avoiding a scratch of the polished workpiece.

The vitrified bond layer 140 consists of a borosilicate glass including at least $SiO_2$ and $B_2O_3$ such that the content of $SiO_2$ therein is 40–70 wt % and the content of $B_2O_3$ therein is 10–30 wt %. The chemical composition of the borosilicate glass may include, for example, 40–70 wt % of $SiO_2$, 0–20 wt % of $Al_2O_3$, 10–30 wt % of $B_2O_3$, 0–10 wt % of at least one kind of metal oxide RO which is selected from alkaline earth metals, and 0–10 wt % of at least one kind of metallic oxide $R_2O$ which is selected from alkaline metals. This arrangement makes it possible to burn or fire the vitrified bond layer 140 at a low temperature, for example, of 900° C., thereby facilitating the manufacturing of the dressing tool 124.

The first and second abrasive grains 136, 138 may be made of diamond, CBN, alumina, silicon carbide, silicon nitride, mullite, silicon dioxide ($SiO_2$) or other material. For example, the first abrasive grains 136 may be diamond abrasive grains, while the second abrasive grains 138 may be alumina abrasive grains whose hardness is lower than the diamond abrasive grains. According to this arrangement, the first abrasive grains 136 which serve to dress the polishing pad 118 have a comparatively high degree of hardness, while the second abrasive grains 138 which serve to prevent contact of the vitrified bond layer 140 with the polishing pad 118 have a comparatively low degree of hardness and are made of the material comparatively cheap, thereby reducing the manufacturing cost of the vitrified bond tool 124.

The first abrasive grains 136 protrude from the vitrified bond layer 140 such that a distance over which each one of the first abrasive grains 136 protrudes from the vitrified bond layer 140 corresponds to 20–70% of a diameter of the first abrasive grain 136. This construction permits the first abrasive grains 136 to be held by the vitrified bond layer 140 with a sufficiently high strength of the bonding of the first abrasive grains 136 to the support body 128, thereby preventing removal of the first abrasive grains 136 from the vitrified bond layer 140 or the support body 128. If the protruding distance of each first abrasive grain 136 is larger than 70% of the diameter of the first abrasive grain 136, the first abrasive grain 136 cannot be held by the vitrified bond layer 140 with a sufficiently high bonding strength. If the protruding distance of each first abrasive grain 136 is smaller than 20% of the diameter of the first abrasive grain 136, the dressing capacity of the dressing tool 124 is reduced.

The difference between the abrasive grains 136, 138 and the vitrified bond layer 140 in thermal expansion coefficients and the difference between the support body 128 and the vitrified bond layer 140 in thermal expansion coefficients are preferably not larger than $5\times10^{-6}$, more preferably not larger than $4\times10^{-6}$, and still more preferably not larger than $3\times10^{-6}$. This arrangement is effective to prevent cracking of the tool 124 during the firing step or after the firing step.

The mixture of the first and second abrasive grains 136, 138 which is sprinkled over the dressing surface 130 has the ratio of the number of the second abrasive grains 138 to the number of the first abrasive grains 136 is 1–10, or more preferably 2–5. This arrangement is effective to increase a load applied to each one of the first abrasive grains 136, thereby improving the dressing performance of the dressing tool 124. If the above-described ratio is lower than 1 or 2, namely, if the number of the first abrasive grains 136 relative to the number of the second abrasive grains 138 is too increased, the load applied to each first abrasive grain 136 is made too small, thereby reducing the dressing performance of the dressing tool 124. On the other hand, if the above-described ratio is higher than 5 or 10, namely, if the number of the first abrasive grains 136 relative to the number of the second abrasive grains 138 is too reduced, the load applied to each first abrasive grain 136 is made too large, thereby increasing possibility of removal of the first abrasive grains 136.

The inorganic-bonding-agent paste or the abrasive-grains-adhering paste, which is used in the inorganic-bonding-agent-paste applying step 142 or the dotted-pattern printing step 148, is a slurry liquid which includes an inorganic-bonding-agent powder dispersed in an organic solvent, water or other solvent, and which further includes, as needed, a dispersing agent serving to restrain agglomeration of the inorganic-bonding-agent powder, a thickener serving to increase the viscosity of the paste for facilitating the printing of the paste on the dressing surface 130, and a caking agent serving to bond the inorganic-bonding-agent powder to the substrate when the paste is dried. It is noted that the dispersing agent, thickener and caking agent are dissipated at the firing step 160.

In the process of manufacturing the dressing tool 124, before the implementation of the dotted-pattern printing step 148, the inorganic-bonding-agent-paste applying step 142 is implemented to apply the inorganic-bonding-agent paste on the entirety of the dressing surface 130 of the support body 128. In this inorganic-bonding-agent applying step 142, the inorganic-bonding-agent paste is applied onto the dressing surface 130 of the support body 128 with a sufficiently large amount thereof which permits the first abrasive grains 136 to be bonded to the support body 128 with a sufficiently large bonding strength. Thus, in the dotted-pattern printing step 148, the abrasive-grains-adhering paste is printed with a thickness thereof not so large as where this inorganic-bonding-agent applying step 142 is not implemented, namely, where the first and second abrasive grains 136, 138 have to be fixed to the support body by only the abrasive-grains-adhering paste. In other words, where this inorganic-bonding-agent applying step 142 is implemented before the abrasive-grains-adhering paste is printed, the thickness of the abrasive-grains-adhering paste no longer has to be so large, as long as the thickness of the printed abrasive-grains-adhering paste is sufficiently large for permitting the first and second abrasive grains 136, 138 to merely adhere to the abrasive-grains-adhering paste. Therefore, the operation for printing the abrasive-grains-adhering paste is facilitated without a risk of dripping of the dots of the dotted pattern of the abrasive-grains-adhering paste, which dripping would be caused where the thickness of the printed abrasive-grains-adhering paste is very large.

The dots of the pattern layer 150 formed in the dotted-pattern printing step 148 are arranged on the dressing surface 130, with a density of the dots being constant over the entirety of the dressing surface 130 such that the number of the dots per unit area is constant over the entirety of the dressing surface 130. This arrangement is effective to substantially equalize loads applied to the respective first abrasive grains 136, to each other, thereby increasing the polishing efficiency and preventing removal of the first abrasive grains 136.

Each of the dots preferably has a diameter corresponding to 30–70% of the average diameter of the first abrasive grains 136, so that each one of the first abrasive grains 136 adheres to the corresponding one of the dots when the abrasive grains 136 are sprinkled over the pattern layer 150 formed on the dressing surface 130.

While the various preferred embodiments of the present invention have been described above for illustrative purpose only, it is to be understood that the invention is not limited to the details of the illustrated embodiments.

In the illustrated embodiments, the support body 1, 11, 21 or 28 of the vitrified bond tool or the dressing tool is made of the sintered body of the inorganic material or the glass having a high fusing point. However, the vitrified bond tool or the dressing tool may consist of a support body made of a stainless steel or other metallic material, and an inorganic material member which has abrasive grains attached thereto and which is bonded to the metallic support body.

The paste for forming the pattern layer 3, 12, 22 or 150 does not necessarily have to include the inorganic bonding agent, as long as the paste has a high degree of adhesiveness which permits the abrasive grains to adhere to the paste.

The paste for forming the backing layer 2 or 144, the pattern layer 3, 12, 22 or 150, or the coating layer 24 may be applied to the corresponding surface by an ink-jet method.

The paste for forming the backing layer 2 and the paste for forming the pattern layer 3 in the first embodiment may be different from each other in component, as long as both of the pastes include the inorganic material powder. Similarly, the paste for forming the backing layer 144 and the paste for forming the pattern layer 150 in the fourth embodiment may be different from each other in component, as long as both of the pastes include the inorganic material powder. For example, the paste for forming the backing layer 2 or 144 may be an aqueous paste so as to be easily sprayed, while the paste for forming the pattern layer 3 or 150 may be an organic solvent paste having a high degree of viscosity and a thixotropic property, so as to be easily screen-printed.

The paste for forming the pattern layer 3 or 150 may be printed in the dotted pattern, after forming a non-absorptive layer on the backing layer 2 or 144, or after firing the backing layer 2 or 144. This arrangement is effective to prevent the solvent of the paste printed in the dotted pattern from being absorbed by the backing layer 2 or 144 which has been dried and solidified, whereby rapid drying of the printed paste can be prevented.

While each dot of the pattern layer 3, 12, 22 or 150 is a circular shape in the above-illustrated embodiments, the dot may have a triangular, rectangular or other shape.

While the firing step is implemented in a non-oxidizing atmosphere or a nitrogen atmosphere for the purpose of preventing deterioration of the diamond, the firing step does not necessarily have to be implemented in a non-oxidizing atmosphere if the abrasive grains are made of material which does not change in quality with implementation of the firing step with an oxidizing atmosphere.

In the fourth embodiment, the above-described abrasive-grains mixing step 152 may be implemented in a place other than where the dressing tool 124 is produced. An equivalent to the mixture of the first and second abrasive grains 136, 138 is commercially available. Thus, the purchased mixture may be used in the abrasive-grains adhering step 154.

It is to be understood that the present invention may be embodied with various other changes, modifications and improvements, which may occur to those skilled in the art, without departing from the spirit and scope of the invention defined by the following claims.

What is claimed is:

1. A vitrified bond tool providing a dressing tool to be brought into sliding contact with a polishing surface of a polishing tool, which polishes a workpiece held in sliding contact with the polishing tool in a chemical mechanical polishing operation, said vitrified bond tool comprising:

a support body;

a vitrified bond layer which is formed on a working surface of said support body; and a plurality of abrasive grains which are held by said vitrified bond layer so as to be fixed relative to said working surface of said support body and which are spaced apart from each other with spacing between adjacent ones of said abrasive grains;

said vitrified bond tool, further comprising, in addition to said plurality of abrasive grains as a plurality of first abrasive grains, a plurality of second abrasive grains whose average diameter is smaller than an average diameter of said first abrasive grains;

wherein said working surface of said support body is a dressing surface which is forced onto said polishing surface of said polishing pad and which constitutes a part of a surface layer of said support body, at least said surface layer of said support body being made of an inorganic material; and wherein said second abrasive grains are held by said vitrified bond layer so as to be fixed relative to said dressing surface of said support body, such that said second abrasive grains are mingled together with each other, and such that said second abrasive grains are positioned between said first abrasive grains and are spaced apart from said first abrasive grains.

2. A vitrified bond tool according to claim 1, wherein said vitrified bond layer consists of a borosilicate glass including at least $SiO_2$ and $B_2O_3$ such that the content of $SiO_2$ therein is 40–70 wt % and the content of $B_2O_3$ therein is 10–30 wt %.

3. A vitrified bond tool according to claim 1, wherein said first abrasive grains have a higher degree of hardness than said second abrasive grains.

4. A vitrified bond tool according to claim 1, wherein the ratio of the number of said second abrasive grains to the number of said first abrasive grains is 1–10.

5. A method of manufacturing the vitrified bond tool as defined in claim 1, comprising the steps of:

mixing said first and second abrasive grains with each other with a predetermined ratio of the number of said second abrasive grains to the number of said first abrasive grains;

printing an abrasive-grains-adhering paste on said dressing surface, such that a pattern layer as a precursor of said vitrified bond layer is formed of said abrasive-grains-adhering paste on said dressing surface, in a dotted pattern comprising a plurality of dots, each of said plurality of dots having a diameter which is smaller than an average diameter of said first abrasive grains and which is larger than 30% of said average diameter of said first abrasive grains so that, at most, a single one of said first abrasive grains can adhere to each one of said plurality of dots when said first and second abrasive grains are sprinkled over said pattern layer;

sprinkling said first and second abrasive grains over said pattern layer formed on said dressing surface, so that ones of said first and second abrasive grains adhere to said pattern layer;

removing the others of said first and second abrasive grains which do not adhere to said pattern layer; and firing said pattern layer and said ones of said first and second abrasive grains, so that said ones of said first and second abrasive grains are held by said vitrified bond layer, so as to be fixed relative to said dressing surface of said support body.

6. A method according to claim 5, wherein said predetermined ratio of the number of said second abrasive grains to the number of said first abrasive grains is 1–10.

7. A method according to claim 5, further comprising the step of applying an inorganic-bonding-agent paste on said dressing surface of said support body, before said abrasive-grains-adhering paste is printed, so that a backing layer as a precursor of said vitrified bond layer is formed of said inorganic-bonding-agent paste on said dressing surface.

8. A method according to claim 5, wherein said dots of said pattern layer are arranged on said dressing surface with a density of said dots being constant over the entirety of said dressing surface, such that the number of said dots per unit area is constant over the entirety of said dressing surface.

9. A method according to claim 5, wherein each of said dots has a diameter corresponding to 30–70% of said average diameter of said first abrasive grains.

10. A method according to claim 5, wherein said polishing tool comprises a polishing pad which includes a urethane resin.

11. A method according to claim 5, wherein said polishing tool comprises a polishing pad which includes a fabric cloth.

* * * * *